US005436701A

United States Patent [19]

Shimojo et al.

[11] Patent Number: 5,436,701

[45] Date of Patent: Jul. 25, 1995

[54] IMAGE FORMING METHOD, IMAGE FORMING APPARATUS AND APPARATUS UNIT

[75] Inventors: Minoru Shimojo; Toshiaki Nakahara; Kazuyoshi Hagiwara, all of Tokyo; Masami Fujimoto, Kawasaki; Kiyoshi Mizoe, Yokohama, all of Japan

[73] Assignee: Canon Kabushiki Kaisha, Tokyo, Japan

[21] Appl. No.: 341,930

[22] Filed: Nov. 16, 1994

Related U.S. Application Data

[63] Continuation of Ser. No. 77,878, Jun. 18, 1993, abandoned.

[30] Foreign Application Priority Data

Jun. 19, 1992 [JP] Japan ..... 4-184713

[51] Int. Cl.[6] ..... G03G 9/083

[52] U.S. Cl. ..... 355/219; 430/106.6; 430/109

[58] Field of Search ..... 355/219, 245; 430/66, 430/67, 96, 106.6, 109, 904

[56] References Cited

U.S. PATENT DOCUMENTS

| | | | |
|---|---|---|---|
| 2,297,691 | 10/1942 | Carlson . | |
| 4,966,829 | 10/1990 | Yasuda et al. | 430/109 |
| 5,140,371 | 8/1992 | Ishihara et al. | 355/219 |
| 5,213,933 | 5/1993 | Osaki et al. | 430/106.6 |

FOREIGN PATENT DOCUMENTS

| | | |
|---|---|---|
| 4223910 | 11/1957 | Japan . |
| 4324748 | 10/1958 | Japan . |
| 63-30850 | 2/1988 | Japan . |
| 63-32182 | 6/1988 | Japan . |
| 63-149669 | 6/1988 | Japan . |
| 63-276106 | 11/1988 | Japan . |
| 2-123385 | 5/1990 | Japan . |
| 2-235069 | 9/1990 | Japan . |
| 2-264278 | 10/1990 | Japan . |
| 2-272459 | 11/1990 | Japan . |

*Primary Examiner*—Joan H. Pendegrass
*Attorney, Agent, or Firm*—Fitzpatrick, Cella, Harper & Scinto

[57] ABSTRACT

The present invention relates to an electrophotographic image forming method characterized in using a photosensitive member having an organic photoconductive layer and fluorine-containing resin particles in the surface, a contact charging means being in contact with the photosensitive member to electrostatically charge it, a contact transfer means being in contact with the photosensitive member to transfer the developed image to the transfer medium;

wherein the toner to be used for developing the latent image is a magnetic toner comprising at least a magnetic material and a binder resin, wherein the binder resin contains a polymer synthesized from vinyl monomer in the presence of an aromatic organic solvent in an amount of 50 parts by weight or more on the basis of 100 parts of the binder resin, and the amount of the residual aromatic organic solvent in the magnetic toner is 500 ppm by weight or less.

109 Claims, 4 Drawing Sheets

IMAGE FORMING METHOD, IMAGE FORMING APPARATUS AND APPARATUS UNIT

This application is a continuation of application Ser. No. 08/077,878 filed Jun. 18, 1993, now abandoned.

BACKGROUND OF THE INVENTION

1. Field of the Invention

The present invention relates to an image forming method for converting an electrostatic latent image into a visible image in electrophotography or electrostatic printing. More particularly, it relates to an image forming method, an image forming apparatus and an apparatus unit in electrophotography, having a step of contact charging of an electrostatic latent image bearing member (herein after "photosensitive member") by means of a charging member being externally applied with a voltage and in contact with the photosensitive member, and a step of electrostatic contact transfer of the developed image to a transfer medium by means of a transfer member externally being applied with a voltage and pressed against a transfer medium.

2. Related Background Art

For electrophotography, various methods are known as disclosed in U.S. Pat. No. 2,297,691, Japanese Patent Publications No. 42-23910 and No. 43-4748. In general, copies are obtained by forming an electrostatic latent image on a photosensitive member having a photoconductive material, and subsequently developing the latent image with a toner by various means, transferring the toner image to a recording medium such as paper if necessary, and by fixing with heat, pressure, heat-and-pressure, or solvent vapor. The toner remained on the photosensitive member is cleaned by various means, and then the above process is repeated.

In recent years, such copying apparatus are not only used in office work for copying originals, but they have come into use as an information output machinery in combination with other information processing machines by the introduction of digital techniques, or as a multi-functional copying machine which can process and edit the image informations to prepare new originals, or as personal copying machines for private use.

Thus, the higher speed and higher image quality, and more down-sizing are strongly required for the apparatus, as well as the higher reliability.

In printers or copying machines using electrophotographic techniques, corona dischargers have been widely used, i) as a means to uniformly charge the surface of a photoconductor (an electrostatic latent image bearing member) and ii) as a means to transfer a developer-developed image from the surface of the photosensitive member. Recently, a new method has been studied and developed to practical use in charging or image transfer processes, in which direct charging or image transfer is carried out by bringing in contact or pressing a charging member to the surface of the photosensitive member while externally applying a voltage to the charging member.

Such a method is disclosed, for example, in Japanese Patent Applications Laid-open No. 63-149669 and No. 2-123385. These are concerned with contact charging or contact transfer process, wherein an photosensitive member is uniformly charged by pressing a conductive elastic roller to which a voltage is applied externally. The uniformly charged photosensitive member is then exposed to form thereon an electrostatic latent image, end after the developement process, another conductive elastic roller with an applied voltage is pressed to the developed image bearing member with a transfer medium passing between to transfer the developed image to the transfer medium, followed by fixation to obtain a copied image.

An example of the image forming method having such a contact charging system and a contact transfer system is explained below with reference to a schematic illustration in FIG. 4.

Reference numeral 101 denotes a rotating drum type image bearing member (photosensitive member). The photosensitive member 101 is basically comprised of a conductive substrate layer 101*b* made of aluminum or the like and a photoconductive layer 101*a* formed on it, and it clockwise rotates as viewed in the drawing, at a given peripheral speed (process speed).

Reference numeral 102 denotes a charging roller, which is basically comprised of a mandrel at the center and a conductive elastic layer formed on its periphery. The charging roller 102 is in contact with the surface of the photosensitive member 101 at a given pressure, and rotates following the rotating photosensitive member 101. Reference numeral 103 denotes a charging bias power supply from which a voltage is applied to the charging roller 102. Application of a bias to the charging roller 102 charges the surface of the photosensitive member 101 to a given polarity and potential. Subsequent imagewise exposure 104 forms electrostatic latent images, which are successively converted into visible toner images through a developing means 105.

Reference numeral 106 denotes a transfer roller, which is basically comprised of a mandrel 106*b* at the center and a conductive elastic layer 106*a* formed on its periphery. The transfer roller 106 is in contact with the surface of the photosensitive member 101 at a given pressure, and rotates at a speed equal to, or different from, the peripheral speed of the photosensitive member 101. As a transfer medium 108 is transported between the photosensitive member 101 and the transfer roller 106, a bias with a polarity reverse to that of the toner is applied from a transfer bias power supply 107 to the transfer roller 106, so that the toner image on the photosensitive member 101 is transferred to the surface of the transfer medium 108.

Subsequently, the transfer medium 108 is transported to a fixing assembly 111 basically comprised of a fixing roller 111*a* internally provided with a halogen heater, and an elastic-material pressure roller 111*b* which is in contact with 111*a* at a given pressure, and while the transfer medium 108 is passing between the rollers 111*a* and 111*b*, the toner image is fixed on the transfer medium 108 and output as a printed image.

After the transfer of the toner image, adherants such as untransferred toner are removed from the surface of the photosensitive member 101 to clean the surface by means of a cleaning assembly 109 provided with an elastic cleaning blade which is in pressure contact with the photosensitive member 101 in the counter direction. The surface is then erased through a charge eliminating exposure assembly 110, and is repeatedly used for image formation.

Such a contact charging and contact transfer system can achieve uniform charging of a photosensitive member and satisfactory image transfer therefrom at a bias of a lower voltage compared with corona charging and corona transfer, and is advantageous in down sizing of chargers and in preventing the generation of corona discharge by-products such as ozone.

In the image forming apparatus as described above, however, the external surface of the photosensitive member is abraded by the cleaning blade or by a developer as the image formation is repeated. Thus the charge performance may change along the change, in equivalent capacity due to the decrease in the thickness (layer thickness or film thickness) of the photosensitive member.

When image formation is repeated and the film thickness of the photosensitive member decreases, the direct currents flowing to the charging roller increases and the surface potential on the external surface of the photosensitive member rises. The decrease in the film thickness of the photosensitive member and the rise of the surface potential cause an increase in development contrast which increases the developed image density and at the same time gives insufficient reverse contrast to the potential of a white image, resulting in "fogged" images because the white apes is thinly developed with the developer.

Thus the poop mechanical durability such as thinning of the photosensitive member greatly affects the lifetime of the photosensitive member.

To cope with this problem, an organic photosensitive member having a surface layer containing a lubricant such as a fine fluorine resin powder is proposed in Japanese Patent Application Laid-open No. 63-30850 to reduce the wear of the surface layer of the photosensitive member and prevent deterioration of its charge performance.

As for the transfer roller, it is known that the relationship between the voltage applied thereto and the current flowing therethrough, will greatly varies depending on the environmental factors. Moreover, ususally any size of the transfer medium can be used in the apparatus of this type provided it is not larger than the maximum-size transfer medium. Therefore, there becomes the area where the transfer medium is not present and the photosensitive member comes into direct contact with the transfer roller when a small-size transfer medium is used, which causes uneven facility of current flow inviting voltage drop.

That is, in the contact transfer system, it is difficult to secure good transfer performance for all sorts of transfer mediums in all environmental conditions by either constant voltage control or constant current control. Accordingly, when transfer efficiency lowers, it becomes impossible to meet various needs for copying materials including post cards, OHP films, etc. which are unfavorable for the transfer. The "transfer hollow" phenomenon (blank areas due to poor transfer), which is a kind of faulty transfer, may also occur at the area where the developer tends to gather (an edge development area), e.g., the area corresponding to the contour or line of an image. This is considered due to the developer laid in a larger quantity on the edge development area than other usual areas to tend to cause agglomeration of the developer, resulting in a lowering of response to a transfer electric field. Thus, this system has the problem that it is difficult to obtain high-quality images faithful to latent images.

To overcome this problem, some improvements have been achieved in the control methods proposed in Japanese Patent Application Laid-open No. 63-276106 and No. 2-264278, but is still unsatisfactory.

In relation to the step of fixing toner images to transfer mediums such as transfer paper, the most prevalent method at present is heat-pressure system using a heating roller, i.e., heat-roll fixing system. In the heat-roll fixing system, waiting time for the heating roller to reach a given temperature is required, which is shortened as the speed of the apparatus is increased. Accordingly, faulty fixing tends to occur because of the instant fixation or the temperature drop of-the heating roller due to the pass of the transfer medium. Moreover, since the heating roller surface comes into contact with melted toner images, the toner images may partly adhere to the surface of a fixing roller, which may be further transferred to the subsequent transfer medium, causing so-called offset phenomenon.

For this reason, improvements in fixing performance of the developer have been sought, and a proposal is made in Japanese Patent Publication No. 63-32182 for the purpose of improving a low-temperature fixing performance of toners. In that publication, a toner containing as a binder resin component a vinyl polymer having at least one distribution peak in each of specific low-molecular weight and high-molecular weight regins is proposed. The toner contains the low-molecular weight component in a relatively large amount so that the low-temperature fixing performance can be improved. Further, Japanese Patent Application Laid-open No. 2-235069, disclosed a magnetic toner containing a binder resin having two peaks in its molecular weight distribution, in which, each dispersion ratio of the low-molecular-weight region and the high-molecular-weight region from the minimal point between two peaks as a reference point, is made small, to improve low-temperature fixing performance and anti-offset properties.

Although the toner as described above is improved in fixing performance, use of such a magnetic toner in an image forming apparatus having the contact charging system and the contact transfer system tends to cause the transfer hollow. This is because a solvent used in the solution polymerization of the resin remains in the magnetic toner in a large quantity, accelerating the agglomeration of toner because of the pressure applied in the transfer step.

Although one may contemplate to produce vinyl resins by polymerization other than the solution polymerization, as is stated in Japanese Patent Application Laid-open No. 2-272459, the solution polymerization is considered essential as a polymerization process for vinyl resins to obtain a sufficient (low-temperature) fixing performance.

Organic photosensitive members (organic photoconductors) are prevalently used in medium-speed machines in order to reduce the size and the cost of the machine. In particular, Japanese Patent Application Laid-open No. 63-30850 discloses, as previously stated, an organic photosensitive member having a surface layer containing a lubricant such as a fine fluorine resin powder for the purpose of decreasing the wear of the surface layer of an organic photosensitive member to prevent deterioration of its charge performance. The organic photosensitive member containing such a fine fluorine resin powder certainly has a longer lifetime itself. However, when a magnetic toner containing a binder resin synthesized from vinyl monomers in the presence of an aromatic organic solvent suitable for solution polymerization is used for image development, the aromatic organic solvent remaining in the magnetic toner in a large quantity may contaminate the surface resin of the organic photosensitive member, so that the resin component of the magnetic toner tends to adhere to the surface of the photosensitive member, tending to cause filming. Moreover, when the surface layer of the photosensitive member contains the fine fluorine resin powder, the surface of the photosensitive member is not much abraded by a cleaning blade or the magnetic toner, resulting in the accumulation of the resin component of the magnetic toner on the surface of the photosensitive member in a large quantity, that is, more filming tends to occur.

SUMMARY OF THE INVENTION

An object of the present invention is to provide an image forming method, an image forming apparatus and an apparatus unit that have solved the problems as discussed above.

Another object of the present invention is to provide an image forming method, an image forming apparatus and an apparatus unit that may cause no, or little transfer hollow if any, when an image is formed by using a contact charging means and a contact transfer means both of which are in pressure contact with an photosensitive member having an organic photoconductive layer.

Still another object of the present invention is to provide an image forming method, an image forming apparatus and an apparatus unit which enable a good charge performance, stable chargeability during use and images that are sharp and free from fog and density decrease, when an image is formed using a contact charging means and a contact transfer means both of which are in contact with an photosensitive member having an organic photoconductive layer.

A further object of the present invention is to provide an image forming method, an image forming apparatus and an apparatus unit in which a magnetic toner is used to form images, said toner having a superior storage stability causing little agglomeration, superior low-temperature fixing performance and anti-offset properties as well as a broad fixing temperature region.

A still further object of the present invention is to provide an image forming method, an image forming apparatus and an apparatus unit that do not-cause contamination or filming of the surface of an photosensitive member having an organic photoconductive layer, when images are formed using a contact charging means and a contact transfer means.

The present invention provides an image forming method comprising;

bringing a contact charging member into contact with the surface of an photosensitive member having a photoconductive layer, and applying a bias voltage to said contact charging means to electrostatically charge said photosensitive member; said photosensitive member containing fluorine-containing fine resin particles in its surface;

forming an electrostatic latent image on the electrostatically charged photosensitive member through a latent image forming means;

developing the electrostatic latent image formed on said photosensitive member with a magnetic toner; said magnetic toner comprising magnetic toner particles containing at least a binder resin and a magnetic material;

wherein said binder resin contains a polymer synthesized from vinyl monomers in the presence of an aromatic organic solvent, in an amount of not less than 50 parts by weight based on 100 parts by weight of the binder resin, and said magnetic toner particles contain said aromatic organic solvent in a quantity of not more than 500 ppm based on the weight of the magnetic toner particles;

transferring the toner image to a transfer medium by means of a contact transfer member which is in contact with the surface of the photosensitive member interposing the transfer medium between them; and fixing the toner image on the transfer medium through a fixing means.

The present invention also provides an image forming apparatus comprising;

an photosensitive member having an organic photoconductive layer, capable of bearing an electrostatic latent image; said photosensitive member containing fluorine-containing fine resin particles in its surface;

a contact charging member being in contact with the surface of said photosensitive member and capable of electrostatically charging said photosensitive member upon application of a bias voltage;

a latent image forming means capable of forming an electrostatic latent image on the electrostatically charged photosensitive member;

a developing means capable of developing the electrostatic latent image formed on said photosensitive member; said developing means holding a magnetic toner; said magnetic toner comprising magnetic toner particles containing at least a binder resin and a magnetic material;

wherein said binder resin contains a polymer synthesized from vinyl monomers in the presence of an aromatic organic solvent, in an amount of not less than 50 parts by weight based on 100 parts by weight of the binder resin, and said magnetic toner particles contain said aromatic organic solvent in a quantity of not more than 500 ppm based on the weight of the magnetic toner particles;

a contact transfer member being in contact with the surface of the photosensitive member interposing a transfer medium between them, capable of transferring to the transfer medium the toner image formed by the developing means; and a fixing means capable of fixing the toner image on the transfer medium.

The present invention also provides an apparatus unit comprising an photosensitive member having a photoconductive layer, capable of bearing an electrostatic latent image, and a contact charging member brought into contact with the surface of said photosensitive member and capable of electrostatically charging said photosensitive member upon application of a bias voltage; at least one of said members being held into one unit together with a developing means capable of developing the electrostatic latent image formed on said photosensitive member;

said unit being detachably mounted in the body of an apparatus having;

a latent image forming means capable of forming an electrostatic latent image on the electrostatically charged photosensitive member;

a contact transfer member being in contact with the surface of the photosensitive member interposing a transfer medium between them, capable of transferring to the transfer medium the toner image formed by the developing means; and a fixing means capable of fixing the toner image on the transfer medium;

said photosensitive member containing fluorine-containing fine resin particles in its surface; said developing means holding a magnetic toner; said magnetic toner comprising magnetic toner particles containing at least a binder resin and a magnetic material;

wherein said binder resin contains a polymer synthesized from vinyl monomers in the presence of an aromatic organic solvent, in an amount of not less than 50 parts by weight based on 100 parts by weight of the binder resin, and said magnetic toner particles contain said aromatic organic solvent in a quantity of not more than 500 ppm based on the weight of the magnetic toner particles.

DETAILED DESCRIPTION OF THE PREFERRED EMBODIMENTS

Figure 1:
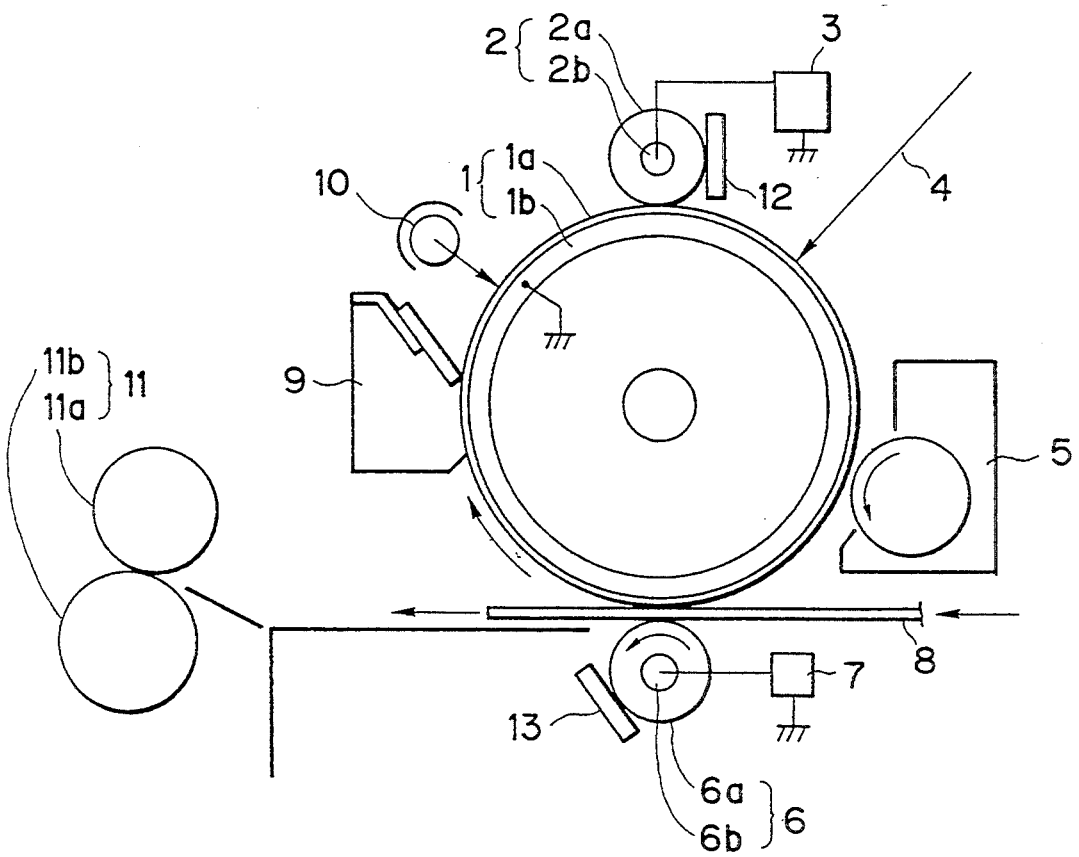
FIG. 1 is a schematic structural view to illustrate the image forming method and image forming apparatus employing the contact charging system and contact transfer system of the present invention.

The present invention achieves the above objects as follows. The binder resin used in the magnetic toner of the present invention comprises a polymer synthesized from vinyl monomers in the presence of an aromatic organic solvent and contains the polymer in an amount of not less than 50 parts by weight based on 100 parts by weight of the binder resin, which secures the molecular weight component that contributes (low-temperature) fixing performance. In addition, the amount of the aromatic organic solvent contained in the magnetic toner particles is not more than 500 ppm based on the weight of the magnetic toner particles, which prevents the agglomeration of the toner particles, transfer hollow, as well as the contamination of the surface of the photosensitive member having an organic photoconductive layer, and improves the storage stability of the toner.

The aromatic organic solvent for the synthesis of the polymer to be used in the binder resin in the present invention may include benzene, toluene, xylene, cyclohexane and tetrahydrofuran. Taking account of polymerization temperature and solvent removing temperature, xylene is most preferred.

In the present invention, the method to synthesis the polymer from vinyl monomers in the presence of the aromatic organic solvent may include, for example, solvent polymerization carried out in the aromatic organic solvent.

In the present invention, the binder resin used in the magnetic toner may be a resin containing a low-molecular-weight component having a molecular weight distribution peak (Mp) of from 4,000 to 30,000 and a high-molecular-weight component having an Mp of from 200,000 to 1,000,000 in a GPC chromatogram. Such a resin is preferable in view of low-temperature fixing performance and anti-offset properties.

The resin having such a low-molecular-weight component and a high-molecular-weight component can be prepared by melt-kneading toner components including the binder resin, a low-molecular-weight polymer and a high-molecular-weight polymer.

This low-molecular-weight polymer should preferably have an Mp of from 4,000 to 30,000, and more preferably from 7,000 to 20,000 in a GPC chromatogram, which is preferable in view of a good low-temperature fixing performance. The high-molecular-weight polymer should preferably have an Mp of from 200,000 to 1,000,000, and more preferably from 300,000 to 700,000, which is preferable in view of good anti-offset properties.

This low-molecular-weight polymer can be synthesized by known polymerization methods such as solution polymerization, suspension polymerization and emulsion polymerization. In particular, solution polymerization is preferred for synthesizing the low-molecular weight polymer.

The high-molecular-weight polymer can be synthesized by known polymerization methods such as solution polymerization, suspension polymerization and emulsion polymerization. In particular, suspension polymerization is preferred for the synthesizing the high-molecular weight polymer and producing a polymer with a preferable particle diameter.

Solvents used in the solution polymerization may include aromatic solvents such as benzene, toluene, xylene, cyclohexane and tetrahydrofuran, ketone type solvents such as acetone, methyl ethyl ketone, methyl isobutyl ketone and cyclohexanone, and amide type solvents such as diemthylformamide and diemthylacetamide.

A polymerization initiator used to polymerize low-molecular-weight monomers may include monofunctional radical initiators as exemplified by t-butyl peroxy-2-ethylhexanoate, t-butyl peroxylaurate, benzoyl peroxide, lauroyl peroxide, octanoyl peroxide, di-t-butyl peroxide, t-butyl cumylperoxide, diisopropylbenzene hydroperoxide, p-methane hydroperoxide, 2,2'-azobisisobutyronitrile, 2,2'-azobis(2-methylbutyronitrile) and 2,2'-azobis(4-methoxy-2,4-dimethylvaleronitrile), which may be used alone or in combination. The radical polymerization initiator may suitably be used in an amount of from 0.1% to 15% by weight, and preferably from 1% to 10% by weight, based on the weight of the monomers that constitute the low-molecular-weight polymer.

As a preferable polymerization initiator for polymerizing high-molecular-weight monomers, a polyfunctional radical initiator should be used, which may include bifunctional radical polymerization initiators as exemplified by 1,1-bis(t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy) valylate, 2,2-bis(t-butylperoxy)butane, 1,3-bis(t-butylperoxy-isopropyl)benzene, 2,5-dimethyl-2,5-di-(t-butylperoxy)-hexane, 2,5-dimethyl-2,5-di-(t-butylperoxy)hexane-3, 2,5-dimethyl-2,5-di-(t-benzoylperoxy)hexane, di-t-butyl peroxyisophthalate, 2,2-bis(4,4-di-t-butylperoxycyclohexyl)propane, di-t-butyl peroxy-α-methylsuccinate, di-t-butyl peroxydimethylglutarate, di-t-butyl peroxyhexahydroterephthalate, di-t-butyl peroxyazelate, 2,5-dimethyl-2,5-di-(t-butylperoxy)hexane, diethylene glycol-bis(t-butyl peroxycarbonate) and di-t-butyl peroxytrimethyladipate; trifunctional radical polymerization initiators as exemplified by tris(t-butylperoxy)triazine and vinyltris(t-butylperoxy)silane; and tetrafunctional radical polymerization initiators as exemplified by 2,2-bis(4,4-di-t-butylperoxycyclohexyl)propane, copolymer compounds of t-butyl peroxyallylcarbonate (e.g., HYPER-B and HYPER-G series, available from Nippon Oil & Fats Co., Ltd.) and copolymer compounds of t-butyl peroxymaleic acid. Any of these can be used alone or in combination thereof, or may be used optionally in combination with other monofunctional radical initiator.

Any of these radical polymerization initiators may suitably be used in an amount of from 0.05% to 5% by weight, and preferably from 0.1% to 3% by weight, based on the weight of monomers that constitute the high-molecular-weight polymer.

In the present invention, the binder resin that can be used in combination with the polymer synthesized from vinyl monomers in the presence of an aromatic organic solvent may include vinyl resins, polyester resins, phenol resins and epoxy resins. In particular, vinyl resins and polyester resins are preferred.

The vinyl monomers that constitute the polymer synthesized from vinyl monomers in the presence of the aromatic organic solvent and the vinyl monomers that constitute the vinyl resin usable in combination with the first-mentioned polymer may include, for example, the following.

They can be exemplified by styrene, styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyelene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylene and unsaturated monoolefins such as ethylene, propylene, butylene and isobutylene; unsaturated diolefins such as butadiene and isoprene; vinyl halides such as vinyl chloride, vinylidene chloride, vinyl bromide and vinyl fluoride; vinyl esters such as vinyl acetate, vinyl propionate and vinyl benzoate; methacrylic acid and $\alpha$-methylene aromatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid and acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; acrylic acid or methacrylic acid derivatives such as acrylonitrile, methacrylonitrile and acylamide; and acroleins. Those obtained by polymerizing any of these vinyl monomers used alone or in combination of two or more kinds are used.

The polyester resin comprises, for example, 45 to 55 mol % of an alcohol component and 55 to 45 mol % of an acid component, in the whole components of the polyester resin.

As the alcohol component, it may include diols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following formula (A):

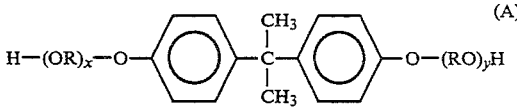

(A)

wherein R represents an ethylene group or a propylene group, x and y are each an integer of 0 or more, and an average value of x+y is 2 to 10; and a diol represented by the following formula (B).

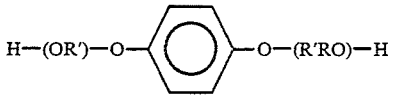

(B)

wherein R represents

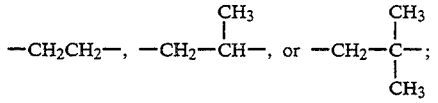

and polyhydric alcohols such as glycerol, sorbitol and sorbitan.

As the acid component, a dibasic carboxylic acid may include benzene dicarboxylic acids or anhydrides thereof such as phthalic acid, terephthalic acid, isophthalic acid and phthalic anhydride; alkyldicarboxylic acids such as succinic acid, adipic acid, sebacic acid and azelaic acid, or anhydrides thereof; succinic acid substituted with an alkyl group having; 6 to 8 carbon atoms, or anhydrides thereof. A trihydric or higher carboxylic acid may include trimellitic acid, pyromellitic acid and benzophenonetetracarboxylic acid, or anhydrides thereof.

An acid component having an unsaturated double bond may include unsaturated dicarboxylic acids such as fumaric acid, maleic acid, citraconic acid, itaconic acid and dodecenylsuccinic acid, or anhydrides thereof.

As the components of the polyester resin that are particularly preferable for carrying out the present invention, the alcohol component includes the bisphenol derivative represented by the formula (A), the acid component includes phthalic acid, terephthalic acid, isophthalic acid or an anhydride thereof, succinic acid, and tricarboxylic acids such as trimellitic acid or an anhydride thereof, and the acid component having an unsaturated double bond includes fumaric acid, maleic acid and maleic anhydride. The acid component having an unsaturated double bond should preferably be contained in an amount of not less than 1% by weight, and more preferably 5% by weight, in the total weight of the acid components.

In the present invention, as the resin that 10 can be used in combination with the polymer synthesized from vinyl monomers in the presence of an aromatic organic solvent, the vinyl polymer can be obtained by conventional methods as exemplified by solution polymerization or suspension polymerization using a peroxide as an initiator. The polyester resin can also be obtained by conventional condensation polymerization.

The binder resin used in the magnetic toner of the present invention may preferably have a glass transition point (Tg) of from 45° to 80° C., and more preferably from 50° to 70° C.

The magnetic toner of the present invention contains a magnetic material that may also serve as a colorant.

The magnetic material contained in the magnetic toner of the present invention may include iron oxides such as magnetite, γ-iron oxide ferrite and iron-excess type ferrite; metals such as iron cobalt and nickel, or alloys of any of these metals with a metal such as aluminum, copper, lead, magnesium, tin, zinc, antimony, beryllium, bismuth, cadmium, calcium, manganese, selenium, titanium, tungsten or vanadium, and mixtures of any of these.

These magnetic materials may preferably be those having an average particle diameter of from 0.1 to 1 μm, and more preferably from 0.1 to 0.5 μm, in approximation. Any of these materials should be contained in the magnetic toner preferably in an amount of from 60 to 110 parts by weight, and particularly preferably from 65 to 100 parts by weight, based on 100 parts by weight of the resin component.

In the magnetic toner of the present invention, a charge control agent may preferably be used by compounding it into toner particles (internal addition) or blending it with toner particles (external addition). The charge control agent enables the optimum electrostatic charge in conformity with developing systems. Particularly in the present invention, it can steady the balance between particle size distribution and charging.

A positive charge control agent may include Nigrosine and products modified with a fatty acid metal salt; quaternary ammonium salts such as tributylbenzylammonium 1-hydroxy-4-naphthoslulfonate and tetrabutylammonium teterafluoroborate; diorganotin oxides such as dibutyltin oxide, dioctyltin oxide and dicyclohexyltin oxide; and diorganotin borates such as dibutyltin borate, dioctyltin borate and dicyclohexyltin borate; any of which may be used alone or in combination of two or more kinds.

Of these, Nigrosine type or quaternary ammonium salt type charge control agents are particularly preferabe. Homopolymers of a monomer represented by the formula:

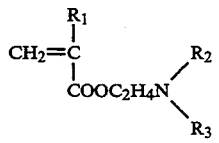

wherein $R_1$ represents H or $CH_3$, and $R_2$ and $R_3$ each represent a substituted or unsubstituted alkyl group, preferably $C_1$ to $C_4$;

or copolymers of polymerizable monomers such as styrene, acrylates or methacrylates as described above may also be used as positive charge control agents. In this case, these charge control agents can also act as a binder resin (as a whole or in part).

As a negative charge control agent usable in the present invention, for example, organic metal complexes and chelate compounds are effective, as exemplified by aluminumacetylacetonato, iron (II) acetylacetonate and chromium 3,5-di-tert-butylsalicylate. Acetylyacetone metal complexes, salicylic acid type metal complexes, or salts thereof are preferred. Salicylic acid type metal complexes (including those substituted with a monoalkyl group and those substituted with a dialkyl group) or salicylic acid type metal salts (including those substituted with a monoalkyl group and those substituted with a dialkyl group) are more preferred.

The charge control agents described above except those serve as a binder resin may preferably be used in the form of fine particles. In this case, the charge control agent may preferably have a number average particle diameter of specifically 4 μm or less, and more preferably 3 μm or less.

When internally added to the toner particles, such a charge control agent may preferably be used in an amount of from 0.1 part to 20 parts by weight, and more preferably from 0.2 part to 10 parts by weight, based on 100 parts by weight of the binder resin.

In order to solve the problem of the offset phenomenon, the magnetic toner particles according to the present invention may contain a polyolefin as a release agent.

The polyolefin that can be used in the present invention may include homopolymers of α-olefins as exemplified by ethylene, propylene, 1-butene, 1-hexene and 4-methyl-1-pentene; copolymers of two or more kinds of α-olefins, and oxides of polyolefins. These polyolefins may also be vinyl type graft-modified polyolefins.

The vinyl type graft-modified polyolefins are comprised of a polyolefin component as described above and a modifying component. The modifying component is grafted into the polyolefin component. Vinyl monomers such as an aliphatic vinyl monomer and an aromatic vinyl monomer are used as the modifying component. For example, the aliphatic vinyl monomer may include methacrylic acid and methacrylates such as methyl methacrylate, ethyl methacrylate, propyl methacrylate, n-butyl methacrylate, isobutyl methacrylate, n-octyl methacrylate, 2-ethylhexyl methacrylate, lauryl methacrylate, stearyl methacrylate, dodecyl methacrylate, phenyl methacrylate, dimethylaminoethyl methacrylate, diethylaminoethyl methacrylate, 2-hydroxyethyl methacrylate, 2,2,2-trifluoroethyl methacrylate, and glycidyl methacrylate; acrylic acid and acrylates such as methyl acrylate, ethyl acrylate, propyl acrylate, n-butyl acrylate, isobutyl acrylate, n-octyl acrylate, lauryl acrylate, stearyl acrylate, dodecyl acrylate, 2-ethylhexyl acrylate, phenyl acrylate, 2-chloroethyl acrylate, 2-hydroxyethyl acrylate, cyclohexyl acrylate, dimethylaminoethyl acrylate, diethylaminoethyl acrylate, dibutylaminoethyl acrylate, 2-ethoxy acrylate, and 1,4-butanediol diacrylate; maleic acid, fumaric acid, itaconic acid, citraconic acid, monoethyl maleate, diethyl maleate, monopropyl maleate, dipropyl maleate, monobutyl maleate, dibutyl maleate, di-2-ethylhexyl maleate, monoethyl fumarate, diethyl fumarate, dibutyl fumarate, di-2-ethylhexyl fumarate, monoethyl itaconate, diethyl itaconate, monoethyl citraconate, and diethyl citraconate. These can be used alone or in combination of two or more kinds.

The aromatic vinyl monomer may include styrene, o-methylstyrene, m-methylstyrene, p-methylstyrene, α-methylstyrene, 2,4-dimethylstyrene, p-ethylstyrene, p-n-butylstyrene, p-tert-butylstyrene, p-n-dodecylstyrene, p-phenylstyrene, and p-chlorostyrene. These can be used alone or in combination of two or more kinds.

The polyolefin can be graft-modified using conventionally known methods. For example, a graft-modified polyolefin can be obtained by readting the polyolefin, the aromatic vinyl monomer and the aliphatic vinyl monomer in the state of a solution or in a molten state with heating in the atmosphere or under application of pressure and in the presence of a radical initiator. The grafting with the aromatic vinyl monomer and the aliphatic vinyl monomer may be carried out at the same time or separately.

The polyolefin used in the present invention should be a low molecular weight polyolefin preferably having a weight average molecular weight of from 2,000 to 30,000, and more preferably from 5,000 to 18,000, as measured by GPC.

In the magnetic toner of the present invention, the polyolefin is added to the binder resin preferably in an amount of from 0.1 part to 20 parts by weight, and more preferably from 0.1 part to 10 parts by weight, based on 100 parts by weight of the binder resin. Its addition in an amount less than 0.1 part by weight can not be effective for the achievement of anti-offset properties. On the other hand, its addition in an amount more than 20 parts by weight will increase the size of the polyolefin particles that separate in the binder-resin, as a result, lowering the anti-blocking properties of the toner.

The magnetic toner particles used in the present invention can be produced as follows: With a binder resin having the resin composition of the present invention and containing magnetic iron oxide, optionally a pigment or dye as a coloring agent, a charge control agent and other additives are thoroughly mixed using a mixing machine such as a ball mill, and then the mixture is melt-kneaded using a heat kneading machine such as a heating roll, a kneader or an extruder to make a pigment or dye dispersed or dissolved in the molten resin etc., followed by cooling for solidification and thereafter pulverization and classification.

In the present invention, the content of the aromatic organic solvent in the magnetic toner particles can be adjusted to 500 ppm or less based on the weight of the magnetic toner particles as follows: After completion of the solution polymerization of the vinyl monomers in the presence of the aromatic organic solvent, the resulting polymer is subjected to drying and solvent removing using a dryer under normal pressure preferably at a temperature of 30° to 50° C. for 5 to 48 hours, and more preferably at a temperature of 35° to 45° C. for 8 to 36 hours. Thereafter, the resulting polymer is further dried to remove the solvent using a vacuum dryer preferably under reduced pressure (absolute pressure: 10 to 500 mmHg) at a temperature of 30° to 50° C. for 5 to 48 hours, and more preferably under reduced pressure (absolute pressure: 50 to 400 mmHg) at a temperature of 35° to 45° C. for 8 to 36 hours. Using the resulting polymer, the magnetic toner particles may be prepared by the above mentioned melt-kneading, pulverization and classification processes.

In the magnetic toner according to the present invention, a fine silica powder may be added to the magnetic toner particles by internal addition or more preferably by external addition. When the magnetic toner is triboelectrically charged by the friction between the magnetic toner particles and the surface of a cylindrical conductive sleeve having a magnetic field generating means in its inside, as the number of contact between the toner particle surfaces and the sleeve surface increases, wear of toner particles tends to occur. Combination of the magnetic toner particles with the fine silica powder remarkably decreases the friction because of interposition of fine silica powder between the magnetic toner particles and the conductive sleeve surface. This enables the longer lifetime of the magnetic toner, and also the production of a developer having a magnetic toner that can exhibit excellent properties even in a long use.

The fine silica powder for this purpose can be produced by either the dry process or the wet process. In view of anti-filming and running performance, it is preferred to use the one produced by dry process.

The dry process herein is a process for producing fine silica powder formed by vapor phase oxidation of a silicon halide. For example, it is a process that utilizes heat decomposition oxidation reaction of silicon tetrachloride gas in oxyhydrogen. The reaction basically proceeds as follows.

$$SiCl_4+2H_2+0_2\rightarrow SiO_2+4HCl$$

In this production step, it is also possible to use, other metal halide such as aluminum chloride or titanium chloride together with the silicon halide to give a composite fine powder of silica with other metal oxide. The fine silica powder of the present invention also includes them.

Commercially available fine silica powders usable in the present invention, produced by the vapor phase oxidation of the silicon halide are, for example, on the market under the following trade names.

Aerosil 130, 200, 300, 380, 0X50, TT600, MOX80, MOX170, COK84 (Aerosil Japan, Ltd.);

Ca-O-SiL M-5, MS-7, MS-75, HS-5, EH-5 (CABOT CO.);

Wacker HDK N20, V15, N20E, T30, T40 (WACKER-CHEMIE GMBH);

D-C Fine Silica (Dow-Corning Corp.); and

Fransol (Franzil Co.).

As the wet process to produce the fine silica powder used in the present invention, conventionally known various methods can be used. For example, there is a method in which sodium silicate is decomposed using an acid, as shown by the following reaction scheme.

$$Na_2O.xSiO_2+HCl+H_2O\rightarrow SiO_2.nH_2O+NaCl$$

Besides, there are a method in which sodium silicate is decomposed using an ammonium salt or alkali salt, a method in which an alkaline earth metal silicate is produced from sodium silicate followed by decomposition using an acid to give silicic acid, a method in which an aqueous sodium silicate solution is passed through an ion-exchange resin to give silicic acid, and a method making use of naturally occurring silicic acid or silicate.

The fine silica powder herein referred to, can be produced from any of anhydrous silicon dioxide (colloidal silica), and other silicates such as aluminum silicate, sodium silicate, potassium silicic, magnesium silicate and zinc silicate.

Commercially available fine silica powders produced by the wet process are, for example, on the market under the following trade names.

| | |
|---|---|
| Carplex | Shionogi & Co., Ltd. |

-continued

| | |
|---|---|
| Nipsil | Nippon Silica Industrial Co., Ltd. |
| Tokusil, Finesil | Tokuyama Soda Co., Ltd. |
| Vitasil | Taki Seihi Co. |
| Silton, Silnex | Mizusawa Industrial Chemicals, Ltd. |
| Starsil | Kamishima Kagaku Co. |
| Himesil | Ehime Yakuhin Co. |
| Sairoid | Fuji-Davison Chemical Ltd. |
| Hi-Sil | Pittsburgh Plate Glass Co. |
| Durosil | Fiillstoff-Gesellschaft Marquart |
| Ultrasil | " |
| Manosil | Hardman and Holden |
| Hoesch | Chemische Fabrik Hoesch K-G |
| Sil-Stone | Stone Rubber Co. |
| Nalco | Nalco Chemical Co. |
| Quso | Philadelphia Quaetz Co. |
| Imsil | Illinis Minerals Co. |
| Calcium Silikat | Chemische Fabrik Hoesh K-G |
| Calsil | Fullstoff-Gesellschaft Marquart |
| Fortafil | Imperial Chemical Industries, Ltd. |
| Microcal | Joseph Crosfield & Sons, Ltd. |
| Manosil | Hardman and Holden |
| Vulkasil | Farbenfabiken Bryer, A.-G. |
| Tufknit | Durham Chemicals, Ltd. |
| Silmos | Shiraishi kogyo Kaisha, Ltd. |
| Starlex | Kamishima Kagaku Co. |
| Fricosil | Taki Seihi Co. |

Of the above fine silica powders, a fine silica powder having a surface specific area, as measured by the BET method using nitrogen absorption, of not less than 30 $m^2/g$, and particularly in the range of from 50 to 400 $m^2/g$, can give good results. The fine silica powder should preferably be used in an amount of from 0.01 part to 8 parts by weight, and more preferably from 0.1 part to 5 parts by weight, based on 100 parts by weight of the toner.

When the magnetic toner according to the present invention is used as a positively chargeable magnetic toner, a positively chargeable fine silica powder, rather than a negatively chargeable one, is more preferabe, since the charge stability is not damaged.

To obtain the positively chargeable fine silica powder, there are a method of treating the untreated fine silica powder as described above with a silicone oil having an organo group conatining at least one nitrogen atom on its side chain, and a method of treating with a nitrogen-containing silane coupling agent, or a method of treating with both of them.

In the present invention, the positively chargeable silica refers to those having a plus triboelectric charge to the iron powder carrier when measured by the blow-off method.

As the silicone oil having a nitrogen atom on the side chain, used when the fine silica powder is treated, it is possible to use a silicone oil having at least a unit structure represented by the following formula:

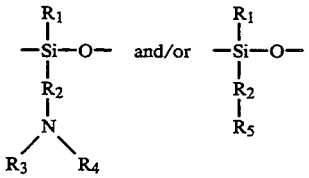

wherein $R_1$ represents a hydrogen atom, an alkyl group, an aryl group or an alkoxyl group; $R_2$ represents an alkylene group or a phenylene group; $R_3$ and $R_4$ each represent a hydrogen atom, an alkyl group or an aryl group; and $R_5$ represents a nitrogen-containing heterocyclic group.

In the above formula, the alkyl group, aryl group, alkylene group and phenylene group may each have an organo group having a nitrogen atom, or may have a substituent such as halogen so long as the charge performance is not damaged.

The nitrogen-containing silane coupling agent used in the present invention generally has a structure represented by the following formula:

$$R_m—Si-Y_n$$

wherein R represents an alkoxyl group or a halogen atom; Y represents am amino group or an organo group having at least one nitrogen atom; and m and n are each an integer of 1 to 3, provided that $m+n=4$.

The organo group having at least one nitrogen atom can be exemplified by an amino group having an organic group as a substituent, a nitrogen-containing heterocyclic group, or a group having a nitrogen-containing heterocyclic group.

The nitrogen-containing heterocyclic group may include unsaturated heterocyclic groups or saturated heterocyclic groups, and known groups are avilable. The unsaturated heterocyclic groups can be derived from the following:

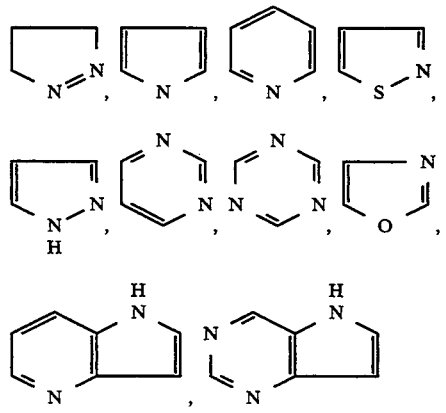

The saturated heterocyclic groups can be derived from the following:

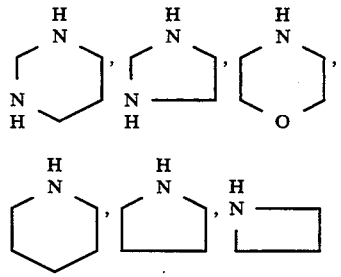

The heterocyclic groups used in the present invention should preferably be those of structure of 5 members or 6 members, taking account of stability.

Examples of such treating agents may be aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyldimethoxysilane, monobutylaminopropyltriethoxysilane, dioctylaminopropyltriethoxysilane, dibutylaminopropyltrimethoxysilane, dibutylaminopropylmonomethoxysilane, dimethylaminophenyltriethoxysilane, trimethoxysilyl-γ-propylphenylamine and trimethoxysilyl-γ-propylbenzylamine. As the nitrogen-containing heterocylic group, those having the above structure can be used. Examples of such compounds may be trimethoxysilyl-γ-propylpiperidine, trimethoxysilyl-γ-propylmorphorine and trimethoxysilyl-γ-propylimidazole.

Thus treated positively chargeable fine silica powder can be effective when it is applied in an amount of from 0.01 part to 8 parts by weight based on 100 parts by weight of the positively chargeable magnetic toner, and, in particular, can exhibit positive chargeability with an excellent stability when added in an amount of from 0.1 part to 5 parts by weight.

Preferably the treated fine silica powder is deposited in an amount of from 0.1 part to 3 parts by weight based on 100 parts by weight of the magnetic toner on the toner particle surfaces. The untreated fine silica powder may also be used in the similar amount.

The fine silica powder used in the present invention may be made hydrophobic by treating with a treating agent such as a silane coupling agent or an organic silicon compound, where the tearing agent reacts with or physically adsorbs to the fine silica powder.

Such an organic silicon compound may include, for example, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane composed of 2–12 siloxane units per molecule and containing a hydroxyl group bonded to each Si in the terminal units. Any of these may be used alone or in the form of a mixture of two or more kinds.

Methods of measuring various values in the present invention will be described below. (1) Measurement of Glass Transition Temperature Tg:

In the present invention, the glass transition point is measured using a differential scanning calorimeter (DSC measuring device), DSC-7 (manufactured by Perkin-Elmer Inc.).

A sample of 5 to 20 mg, preferably 10 mg, is precisely weighed into an aluminum pan. Using an empty aluminum pan as a reference, the measurement is carried out in an environment of normal temperature and humidity with a measuring temperature raised at a rate of 10° C./min from 30° C. to 200° C.

During this temperature rise, a main endothermic peak in the range of temperatures 40° C. to 100° C. is observed. The intersecting point of the differential thermal curve and the line drawn on a middle point of the base lines before and after the appearance of the endothermic peak is defined as the glass transition point Tg in the present invention (JIS K-7172-1987).

(2) Measurement of Molecular Weight:

In the present invention, the molecular weight on the chromatogram obtained by GPC (gel permeation chromatography) are measured under the following conditions.

Columns are stabilized in a heat chamber of 40° C. To the columns kept at this temperature, THF (tetrahydrofuran) as a solvent is flowed at a flow rate of 1 ml per minute, and 50 μl to 200 μl of a THF solution of a sample resin prepared to have a concentration of from 0.05 to 0.6% by weight is loaded thereinto to make measurement.

In measuring the molecular weight of the sample, the molecular weight distribution of the sample is calculated from the calibration curve of the logarithmic value of molecular weights and elution points prepared using several kinds of standard monodisperse polystyrenes. As the standard polystyrene samples to prepare the calibration curve, samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, available from Pressure Chemical Co. or Tosoh Co., Ltd., can be used, and at least about 10 standard polystyrene samples should be measured. An RI (refractive index) detector is used as a detector.

In order to accurately measure the region of molecular weights of from $10^3$ to $2\times10^6$ it is preferable to combine plural commercially available polystyrene gel columns. For example, they may preferably comprise a combination of μ-Styragel 500, $10^3$, $10^4$ and $10^5$, available from Waters Inc.; a combination of Shodex KF-80M, KF-801, 803, 804 and 805, or a combination of KA-802, 803, 804 and 805, available from Showa Denko K.K.; or a combination of TSKgel G1000H, G2000H, G2500H, G3000H, G4000H, G5000H, G6000H, G7000H and GMH, available from Tosoh Co., Ltd. (3) The solvent remaining in a developer is determined in the following way using a gas chromatograph.

As an internal standard, 2.55 mg of DMF in 100 ml of acetone is used as a solvent containing the internal standard. Next, 400 mg of a developer is dissolved in the above solvent to make a 10 ml solution. After the ultrasonication of the solution for 30 minutes, it is left to stand for 1 hour. Next, the solution is filtered using a 0.5 μm filter, and an aliquot of 4 μl is injected.

Gas chromatography Conditions:

Capillary column (30 m×0.249 mm, DBWAX, layer thickness: 0.25 μm)

Detector FID, nitrogen pressure: 0.45 kg/cm

Injection temperature: 200° C., detector temperature: 200° C.; column temperature is raised from 50° C. at a rate of 5° C./minute for 30 min.

Preparation of calibration curve

Standard acetone solutions each conatining the same amount of DMF as the sample solution and a known amount of a solvent to be measured are similarly analyzed by gas chromatography, and the weight/area ratios of the solvent and the internal standard DMF are determined.

The photosensitive member used in the present invention will be described.

The photosensitive member used in the present invention has an organic photoconductive layer, and contains at least fluorine-containing fine resin particles in its surface in order to decrease frictional resistance of the surface.

The photosensitive member may have a surface of an organic photoconductive layer containing an organic photoconductive material, or may also have a protective layer formed on the organic photoconductive layer.

The fluorine-containing fine resin particles used in the photosensitive member of the present invention are comprised of one or more materials selected from polytetrafluoroethylene, polychlorotrifluoroethylene, polyvinylidene fluoride, polydichlorodifluoroethylene, a tetrafluoroethylene/perfluoroalkyl/vinyl ether copolymer, a tetrafluoroethylene/hexafluoropropylene copolymer, a tetrafluoroethylene/ethylene copolymer and a tetrafluoroethylene/hexafluoropropylene/perfluoroalkyl vinyl ether copolymer. Commercially available fluorine-containing fine resin particles can be used without treatment. Those having a weight average molecular weight of from 3,000 to 5,000,000 can be used, and those having a particle diameter of from 0.01 to 10 μm, and preferably from 0.05 to 2.0 μm, can be used.

The organic photoconductive layer of the photosensitive member of the present invention contains at least a charge-generating material and a charge-transporting material as organic photoconductive materials. The charge-generating material may include, for example, phthalocyanine pigments, polycyclic quinone pigments, trisazo pigments, disazo pigments, azo pigments, perylene pigments, indigo pigments, quinacridone pigments, azulenium salt dyes, squarium dyes, cyanine dyes, pyrylium dyes, thiopyrylium dyes, xanthene coloring matter, quinoneimine coloring matter, triphenylmethane coloring matter, styryl coloring matter, selenium, a selenium-tellurium alloy, amorphous silicon and cadmium sulfide.

The charge-transporting material may include, for example, pyrene compounds, N-alkylcarbazole compounds, hydrazone compounds, N,N-dialkylaniline compounds, diphenylamine compounds, triphenylamine compounds, triphenylmethane compounds, pyrazoline compounds, styryl compounds, stilbene compounds, polynitro compounds, polycyano compounds, and also pendant polymers comprising any of these compounds fixed on polymers.

Usually, the above fluorine-containing fine resin particles, charge-generating material, charge-transporting material and so forth are dispersed and incorporated into a binder resin having proper film forming properties to form the protective layer or the organic photoconductive layer. Such binder resins may include polyesters, polyurethanes, polyacrylates, polyethylene, polystyrene, polybutadiene, polycarbonates, polyamides, polypropylene, polyimides, phenol resins, acrylic resins, silicone resins, epoxy resins, urea resins, allyl resins, alkyd resins, polyamide-imide, nylons, polysulfone, polyallyl ethers, polyacetals and butyral resins.

The layer structure of the photosensitive member used in the present invention will be described below. The conductive support may be made of a metal such as iron, copper, gold, silver, aluminum, zinc, titanium, lead, nickel, tin, antimony or indium or an alloy thereof, an oxide of any of these metals, carbon, or a conductive polymer. It may have the shape of a drum such as a cylinder or a column, a belt, or a sheet. The above conductive materials may be molded by itself, or used as the coating materials in vacuum-deposited, or may be processed by etching or plasma treatment. In the case of coating materials, not only the above metal and alloy but also paper and plastic can be used as the support.

Figure 3:
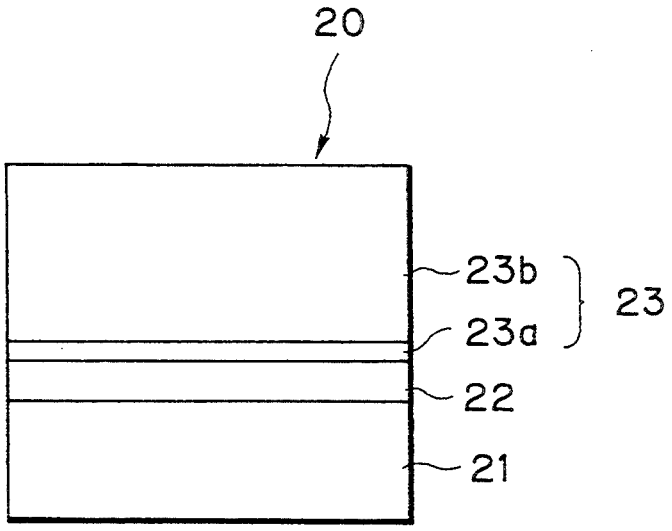
FIG. 3 illustrates an example of the layer structure of an photosensitive member used in the present invention.
Figure 4:
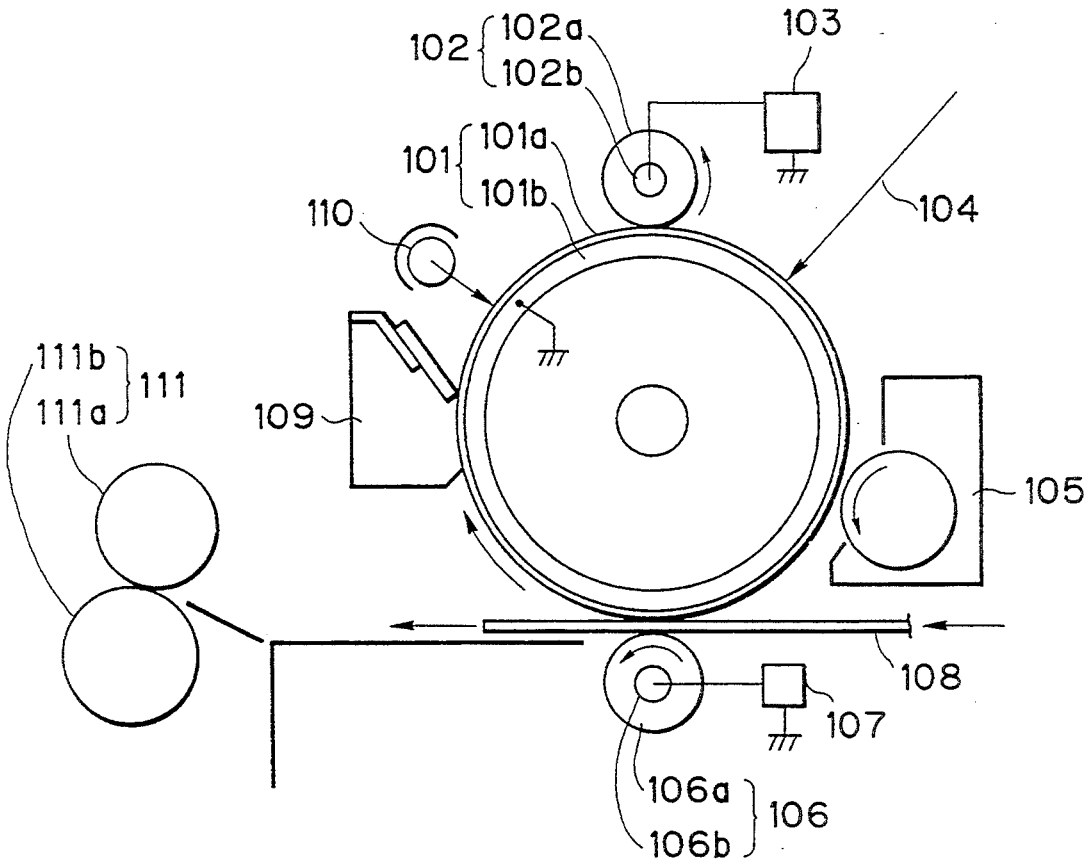
FIG. 4 is a schematic structural view of an image forming apparatus employing the contact charging system and contact transfer system conventionally known in the art.

FIG. 3 shows an example of the layer structure of the photosensitive member used in the present invention.

An organic photoconductive layer 23 in an photosensitive member 20 used in the present invention is formed on a conductive support 21, and may be of either single-layer structure or laminated structure. In the case of the laminated structure, the layer is comprised of at least a charge generation layer **23*a* and a charge transport layer 23*b*. The charge polarity and the polarity of toner will differ when the charge generation layer 23*a* is provided on the conductive support 21 and when the charge transport layer 23*b* is provided on it. The charge generation layer 23*a* may preferably have a film thickness of from 0.001 to 6 μm, and more preferably from 0.01 to 2 μm. The charge-generating material is contained in the charge generation layer 23*a* preferably in a content of from 10 to 100% by weight, and more preferably from 50 to 100% by weight, based on the total weight of the charge generation layer. The thickness of the charge transport layer 23*b* is obtained by subtracting the film thickness of the charge generation layer 23*a* from the organic photoconductive layer 23. The charge-transporting material contained in the charge transport layer 23*b* may preferably be in a content of from 20 to 80% by weight, and more preferably from 30 to 70% by weight, based on the total weight of the charge transport layer 23*b***.

A subbing layer 22 may be provided between the conductive support 21 and the organic photoconductive layer 23. The subbing layer 22 controls charge injection at the interface and functions as an adhesive layer. The subbing layer 22 is mainly composed of a binder resin. It may also contain the above metal or alloy described above, an oxide or salt thereof, a surface active agent, etc. As the binder resin that forms the subbing layer 22, binder resins for the organic photoconductive layer 23 can be used. The subbing layer may preferably have a film thickness of from 0.05 to 7 μm, and more preferably from 0.1 to 2 μm.

The content of the fluorine-containing fine resin particles in the surface of the electrostatic latent photosensitive member of the present invention should preferably be from 5 to 30% by weight, and more preferably from 10 to 25% by weight, based on the total weight of the charge transport layer when the surface is the charge transport layer **23*b* of the organic photoconductive layer 23**, and or from 5 to 40% by weight, and more preferably from 10 to 40% by weight, based on the total weight of the protective layer when the surface is the protective layer.

This protective layer may preferably have a film thickness of from 0.05 μm to 80 μm, and more preferably of from 0.5 μm to 6.0 μm.

The organic photoconductive layer of the photosensitive member should also preferably have a film thickness from 10 to 35 μm, and more preferably from 15 to 30 μm. The film thickness of this organic photoconductive layer includes the film thickness of the protective layer when it has the protective layer.

The photosensitive member used in the present invention can be produced using processes such as vacuum deposition and coating. When coneting method is used, films can have a wide range of film thickness and also a variety of composition. Specifically, coating is carried out using a coating process such as bar coating, knife coating, dip coating, spray coating, beam coating, electrostatic coating, roll coating, atritor coating and powder coating.

The coating material used to form the layer that forms the surface of the photosensitive member can be obtained by dispersing the fluorine-containing fine resin particles at least in the binder resin and a solvent. The mixture is dispersed by means of a ball mill, an ultrasonic, a paint shaker, a Red Devil or a sand mill. The same dispersion method can be used for dispersing the conductive fine powder, pigment, and the charge-generating material when it is a pigment.

A specific example of the image forming apparatus that can be used in the present invention to carry out the image forming method will be described with reference to FIG. 1.

Reference numeral 1 denotes a rotating drum type photosensitive member serving as the photosensitive member. The photosensitive member 1 is basically comprised of a conductive substrate layer 1*b* made of aluminum or the like and a photoconductive layer 1*a* formed on its periphery. The surface portion of the photoconductive layer la is comprised of a charge transport material and a polycarbonate resin containing 8% by weight of fluorine-containing fine resin particles. The photosensitive member is clockwise rotated as viewed in the drawing, at a peripheral speed of 200 mm/s.

Reference numeral 2 denotes a charging roller serving as the contact charging means, which is basically comprised of a mandrel at the center and a conductive elastic layer 2*a* made of of epichlorohydrin rubber containing carbon black formed on its periphery. The charging roller 2 is in pressure contact with the surface of the photosensitive member 1 at a linear pressure of 40 g/cm, and is rotated following the rotating photosensitive member 1. As a cleaning member 12, a felt pad is in contact with the charging roller 2.

Reference numeral 3 denotes a charging bias power supply through which a voltage is applied to the charging roller 2. Application of a bias of DC −1.4 kV to the charging roller 2 charges the surface of the photosensitive member 1 to a polarity and potential of about −700 V.

Then imagewise exposure 4 is carried out to form an electrostatic latent image. The electrostatic latent image is developed by a developer held in a developing means 5 and converted into a visible toner image. Reference numeral 6 denotes a transfer roller serving as the contact transfer member, which is basically comprised of a mandrel 6*b* at the center and a conductive elastic layer 6*a* of an ethylene/propylene/butadiene copolymer containing carbon black formed on its periphery.

The transfer roller 6 is in pressure contact with the surface of the photosensitive member 1 at a linear pressure of 20 g/cm, and is rotated at a speed equal to the peripheral speed of the photosensitive member 1. As a cleaning member 13, a felt pad is in contact with the transfer roller 6.

As a transfer medium 8, A4-size paper is transported between the photosensitive member 1 and the transfer roller 6 when a bias of DC −5kV with a polarity reverse to that of the toner is applied from a transfer bias power supply 7, so that the toner image on the photosensitive member 1 is transferred to the surface of the transfer medium 8. Thus, in the course of transfer, the transfer roller 6 is in contact with the photosensitive member 1 interposing the transfer medium 8 between them.

Subsequently, the transfer medium 8 is transported to a fixing assembly 11 serving as the fixing means, basically comprised of a heating roller 11*a* internally provided with a halogen heater and an elastic-material pressure roller 11*b* pressed to it at a given pressure. The transfer medium 8 is passed between the fixing roller 11*a* and the pressure roller 11*b*, so that the toner image is fixed to the transfer medium 8 and output as a printed image.

From the surface of the photosensitive member 1 from which the toner image has been transferred, contaminants such as remaining untransferred toner are removed to clean the surface by means of a cleaning assembly 9 which is provided with an elastic cleaning blade basically made of polyurethane rubber and is counter-clockwise in pressure contact with the photosensitive member 1 at a linear pressure of 25 g/cm. The surface is then erased through a charge eliminating exposure assembly 10, and is repeatedly used for image formation.

The image forming apparatus may be composed of units in which plural components are selected from the constituents such as the above photosensitive member, developing means and cleaning means and joined as one apparatus unit freely removable from the body of the apparatus. For example, the charging means and at least one of the photosensitive member, the developing means and the cleaning means may be held into one unit, as an apparatus unit freely detachable from the body of the apparatus using a guide means such as a rail provided in the body of the apparatus. Here, the apparatus unit may be constituted of the charging means and the developing means.

Figure 2:
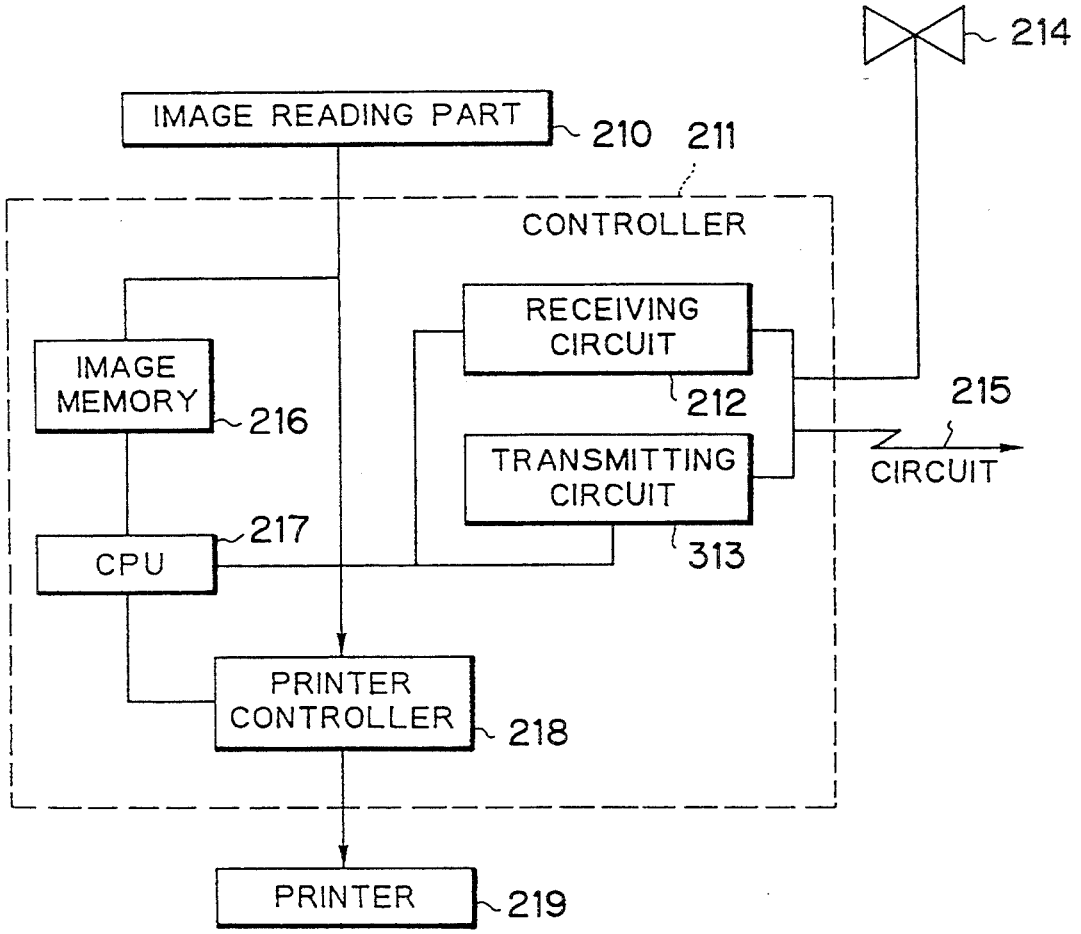
FIG. 2 is a block diagram of a facsimile apparatus in which the image forming apparatus of the present invention is used as a printer.

When the image forming apparatus is used as a printer of a facsimile machine, the imagewise exposure 4 serving as the latent image forming means is digital exposure applied laser light to print the received data. FIG. 2 illustrates an example thereof in the form of a block diagram.

A controller 211 controls an image reading part 210 and a printer 219. The whole of the controller 211 is controlled by CPU 217. Image data outputted from the image reading part is sent to the other :facsimile station through a transmitting circuit 213. Data received from the other station is sent to a printer 219 through a receiving circuit 212. Given image data are stored in an image memory 216. A printer controller 218 controls the printer 219. The numeral 214 denotes a telephone.

An image received from a circuit 215 (image information from a remote terminal connected through the circuit) is demodulated in the receiving circuit 212, and then successively stored in an image memory 216 after the image information is decoded by the CPU 217. Then, when images for at least one page have been stored in the memory 216, the image recording for that page is carried out. The CPU 217 reads out the image information for one page from the memory 216 and sends the coded image information for one page to the printer controller 218. The printer controller 218, having received the image information for one page from the CPU 217, controls the printer 219 so that the image information for one page is recorded.

The CPU 217 receives image information for next page in the course of the recording by the printer 219.

According to the present invention, the binder resin of the magnetic toner particles contains the polymer synthesized from vinyl monomers in the presence of an aromatic organic solvent in an amount of not less than 50 parts by weight based on 100 parts by weight of the binder resin, and also the magnetic toner particles contains the residual aromatic organic solvent in a quantity of not-more than 500 ppm based on the weight of the magnetic toner particles. Hence, when images are formed using the contact transfer means to transfer a toner image to the transfer medium, the transfer means in contact with the photosensitive member interposing a transfer medium, the toner according to the present invention can provide superior low-temperature fixing performance and anti-offset properties, no or little, if any,transfer hollow, stable charge performance during use, and sharp images free from fog and a decrease in image density. Moreover, since the content of the aromatic organic solvent is as small as not more than 500 ppm based on the weight of the magnetic toner particles, the solvent hardly contaminates the surface of the photosensitive member, not causing or hardly causing the filming.

The basic construction and features of the present invention have been described above. The present invention will be described below in greater detail by giving Examples. It, however, should be noted that these by no means limit the present invention. In the following formulation, "part(s)" refers to "part(s) by weight".

Synthesis Example 1

Into a four-necked flask equipped with a nitrogen gas feed pipe, a condenser, a stirrer and a thermometer, 800 parts of xylene was introduced, and stirred under nitrogen flow, while the temperature was raised and maintained at 90° C. Then a mixture of 85 parts of styrene, 15 parts of a butyl acrylate copolymer and 4 parts of di-t-butyl peroxide (DTBP) as an initiator was dropwise added over 8 hours using a continuous dropping device to carry out solution polymerization. Thereafter, drying and solvent removing were carried out under normal pressure at 40° C. for 12 hours to give polymer (A) having a peak at a molecular weight of 10,000 in GPC. In this polymer (A), the residual solvent was in a quantity of 2,300 ppm as measured by gas chromatography.

Synthesis Example 2

Using the polymerizing apparatus of Synthesis Example 1, polymer (B) having a peak at a molecular weight of 13,000 in GPC was obtained in the same manner as in Synthesis Example 1 except that the amounts of styrene and the butyl acrylate copolymer were 83 parts and 17 parts, respectively. In this polymer (B), the residual solvent was in a quantity of 2,700 ppm as measured by gas chromatography.

Synthesis Example 3

The polymer (A) in Synthesis Example 1 was further subjected to drying and solvent removing using a vacuum dryer under reduced pressure (absolute pressure 160 mmHg) at 40° C. for 24 hours to give polymer (C) in which the residual solvent was reduced to 1,100 ppm.

Synthesis Example 4

The polymer (B) obtained in Synthesis Example 2, was further treated in the same manner as in Synthesis Example 3 to give polymer (D) in which the residual solvent was reduced to 1,300 ppm.

Synthesis Example 5

Into a four-necked flask equipped with a nitrogen gas feed pipe, a condenser, a stirrer and a thermometer, 200 parts of ion-exchanged water, 81 parts of styrene, 19 parts of n-butyl acrylate and 0.4 part of an initiator 1,4-bis(di-t-butylperoxycarbonyl) cyclohexane (HTP) were introduced, and solution polymerization was carried out at a polymerization temperature of 90° C. for 24 hours. Thereafter, the product was cooled, washed with water and dried to give polymer (E) having a peak at a molecular weight of 700,000 in GPC.

Synthesis Example 6

Using the polymeration apparatus of Synthesis Example 5, polymer (F) having a peak at a molecular weight of 20,000 in GPC was obtained in the same manner as in Synthesis Example 5 except that suspension polymerization was carried out at a polymerization temperature of 90° C. for 24 hours, using 83 parts of styrene, 17 parts of n-butyl acrylate and 6 parts of an initiator DTBP.

Synthesis Example 7

In an autoclave, a mixture of 86 parts of styrene and 14 parts of butadiene, 1 part of calcium carbonate and 30 parts of benzoyl peroxide as an initiator were dispersed in 1,500 parts of an aqueous 0.1% solution of polyvinyl alcohol of 85 mol % saponification rate, and suspension polymerization was carried out at about 80° C. for 6 hours. Thereafter, the product was cooled, washed with water and dried to give polymer (G) having a peak at a molecular weight of 21,000 in GPC.

These are summarized in Table 1 below.

TABLE 1

| Synthesis Example | Polymer | Composition of polymer and peak molecular weight | | | (1) (ppm) |
|---|---|---|---|---|---|
| 1 | (A) | St-BA | (85:15), | 10,000 | 2,300 |
| 2 | (B) | St-BA | (83:17), | 13,000 | 2,700 |
| 3 | (C) | St-BA | (85:15), | 10,000 | 1,100 |
| 4 | (D) | St-BA | (83:17), | 13,000 | 1,300 |
| 5 | (E) | St-BA | (81:19), | 700,000 | — |
| 6 | (F) | St-BA | (83:17), | 20,000 | — |
| 7 | (G) | St-BD | (86:14), | 21,000 | — |

(1): Quantity of residual solvent used in solution polymerization

Magnetic Toner Production Example I

The following polymers, prepared in Synthesis Examples;

| | |
|---|---|
| Polymer (C) | 56 parts |
| Polymer (E) | 24 parts |
| Polymer (G) | 20 parts |
| were mixed to give binder resin 1. | |
| Binder resin 1 | 100 parts |
| Low-molecular weight polypropylene | 4 parts |
| Magnetic iron oxide | 90 parts |
| Nigrosine | 2 parts |

The above materials were premixed using a Henschel mixer, and the mixture was melt-kneaded at 150° C. using a twin-screw kneading extruder. The kneaded product was left to cool, and thereafter crushed, followed by pulverization and then classification using an air classifier to give a black fine powder (magnetic toner particles) with-a volume average particle diameter of 8.5 μm.

To 100 parts of the black fine powder thus obtained, 0.6 part of positively chargeable hydrophobic silica (BET specific surface area: 200 $m^2/g$) was added, which were then mixed using a Henschel mixer to give positively chargeable insulating magnetic toner I.

In the magnetic toner particles obtained, the residual amount of the solvent used in solution polymerization was as shown in Table 2 below, 380 ppm as measured by gas chromatography.

Magnetic Toner Production Examples II to VII

Positively chargeable insulating magnetic toners II to VII were obtained in the same manner as in Magnetic Toner Production Example I except that the binder resin 1 used therein was replaced with binder resins 2 to 7, respectively, as shown in Table 2 below.

In the magnetic toner particles obtained, the residual amounts of the solvent used in solution polymerization are as shown in Table 2 below.

TABLE 2

| Magnetic toner | Binder resin | Constitution of binder resin: Parts by weight of polymer by solution polymerization parts | Constitution of binder resin: Parts by weight of polymers by other polymerization parts | Residual solvent (ppm)*1 | Peak molecular weight (Mp) of magnetic toner particles |
|---|---|---|---|---|---|
| I | 1 | Polymer (C), 56 | Polymer (E), 24 (sus. polymlzn.)<br>Polymer (G), 20 (sus. polymlzn.) | 380 | 11,000 & 450,000 |
| II | 2 | Polymer (D), 60 | Polymer (E), 20 (sus. polymlzn.)<br>Polymer (G), 20 (sus. polymlzn.) | 460 | 14,000 & 500,000 |
| III | 3 | Polymer (A), 56 | Polymer (E), 24 (sus. polymlzn.)<br>Polymer (G), 20 (sus. polymlzn.) | 1,070 | 11,000 & 450,000 |
| IV | 4 | Polymer (B), 60 | Polymer (E), 20 (sus. polymlzn.)<br>Polymer (G), 20 (sus. polymlzn.) | 1,250 | 14,000 & 600,000 |
| V | 5 | Polymer (C), 40 | Polymer (E), 40 (sus. polymlzn.)<br>Polymer (G), 20 (sus. polymlzn.) | 270 | 17,000 & 750,000 |
| VI | 6 | Polymer (B), 35 | Polymer (E), 45 (sus. polymlzn.)<br>Polymer (G), 20 (sus. polymlzn.) | 880 | 16,000 & 800,000 |
| VII | 7 | — | Polymer (E), 35 (sus. polymlzn.)<br>Polymer (F), 65 (sus. polymlzn.) | — | 24,000 & 550,000 |

*1Quantity of residual aromatic organic solvent in magnetic toner particles sus. polymlzn.: suspension polymerization Photosensitive member Production Example On an aluminum cylinder of 30 mmϕ×360 mm as a substrate, a 5% methanol solution of polyamide resin (trade name: AMILAN CM-8000; available from Toray Industries, Inc.) was applied by dip coating to provide a subbing layer with a thickness of 1 μpm.

Next, 10 parts of a disazo pigment of the structural formula:

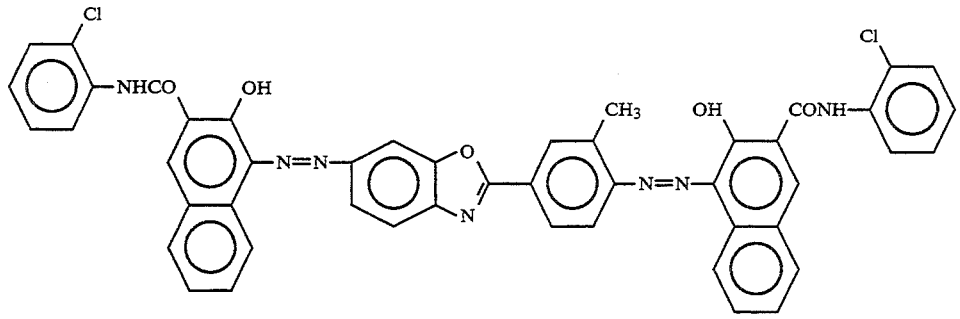

6 parts of polyvinylbutyral resin (trade name: S-LEC BXL; available from Sekisui Chemical Co., Ltd.) and 100 parts of cyclohexane were dispersed using a sand mill making use of glass beads of 1 mm in diameter. To the resulting dispersion, 50 to 100 (appropriately selected) of tetrahydrofuran was added, and the dispersion was coated on the subbing layer, followed by drying at 100° C. for 5 minutes to form a charge generation layer with a thickness of 0.15 μm.

Next, 20 parts of bisphenol-Z type polycarbonate resin (available from Teijin Chemicals Ltd.) as a binder and 20 parts of p-diethylaminobenzaldehyde-N-β-naphthyl-N-phenylhydrazone as a charge-transporting material were discolored in 100 parts of cyclohexane. To the resulting solution, 7 parts of polytetrafluoroethylene fine resin particles (trade name: LUBRON L-2; available from Daikin Industries, Ltd.) were added as fluorine-containing fine resin particles, followed by dispersion for 50 hours using a ball mill made of stainless steel, and further followed by addition of 20 parts of dichloroethane to prepare a charge transport layer coating solution.

This solution was applied on the above charge generation layer, followed by hot-air drying at 100° C. for 90 minutes to form a charge transport layer with a thickness of 25 μm. Thus an photosensitive member I was obtained.

Example 1

An electrophotographic copying machine employing the image forming apparatus shown in FIG. 1, is prepared in which the photosensitive member I was used and the fixing assembly was removed, and the driving conditions were set as follows:

Pressure of charging roller in contact with photosensitive member: 50 g/cm Applied voltage: −1,400 V (DC)

Pressure of transfer roller in contact with photosensitive member: 20 g/cm Applied voltage: −6,000 V (DC)

Difference in peripheral speed with respect to photosensitive member: 1.5% (selected from 0.5, 1.5, 3.0, 5.0, −0.5, −1.5, −3.0 and −5.0%)

Pressure of cleaning blade in contact with the photosensitive member: 20 g/cm

Development bias, Vpp: 1,300 V (AC) Vf: 1,800 Hz Vdc: −210 V (DC)

Distance between photosensitive member and developer carrying member: 399 μm

Process speed: 200 mm/sec,

To the above modified machine, the magnetic toner 1 was charged and unfixed images on transfer mediums were obtained. A fixing assembly removed from an electrophotographic copying machine GP55 (manufactured by Canon Inc.) was modified to a temperature-variable, heat-roller type external fixing assembly, and the unfixed images were fixed under the following conditions to make a fixing test and an offset test.

The nip of the external fixing assembly was set at 5.0 mm and the process speed thereof at 200 mm/sec. Its temperature was changed at intervals of 5° C. within the temperature range of from 100° C. to 50° C., and the unfixed images were fixed at each temperature. The fixed images obtained were rubbed with lintless paper under a load of 50 g/cm$^2$. A fixing temperature at which the image density before rubbing decreased by 5% or less after rubbing was regarded as fixing initiation temperature.

As a result, the fixing initiation temperature was 170° C. and offset began to occur at a temperature of 250° C. (offsetting temperature), giving a superior fixing temperature region.

Using A4-size paper as transfer mediums and also using as an original an A4-size chart having 10 lines of 0.2×20 mm, an image reproduction test was made using the electrophotographic copying machine employing the above image forming apparatus. As a result, good line images free from transfer hollow were obtained.

With the electrophotographic copying machine employing the above modified image forming apparatus, a continuous 20,000 sheet image reproduction test was made using A4-size transfer mediums, using an A4-size original having line images in an image area percentage of 10%, and thereafter the surface of the photosensitive member (the photosensitive member) was examined for the presence of filming, and the quality of the images was checked on the occurrence of transfer hollow in lines.

Results obtained ape shown in Table 3 below.

Example 2

The fixing test, the offset test and the image reproduction test were made in the same manner as in Example 1 except that the magnetic toner used therein was replaced with the magnetic toner II.

Results obtained are shown in Table 3 below.

Comparative Examples 1 to 5

The fixing test, the offset test and the image reproduction test were made in the same manner as in Example 1 except that the magnetic toner used therein was replaced with the magnetic toners III to VII each.

Results obtained are shown in Table 3 below.

TABLE 3

| | Magnetic toner | Fixing initiation temperature | Offsetting temperature | Blank*1 lines | Filming*2 |
|---|---|---|---|---|---|
| Example: | | | | | |
| 1 | I | 170° C. | 250° C. | A | A |
| 2 | II | 175° C. | 240° C. | A | A |
| Comparative Example: | | | | | |
| 1 | III | 170° C. | 250° C. | C | C*2a |
| 2 | IV | 175° C. | 240° C. | C | C*2b |
| 3 | V | 190° C. | >250° C. | A | B*2c |
| 4 | VI | 195° C. | >250° C. | B | C*2b |
| 5 | VII | 195° C. | 240° C. | A | A |

*1transfer hollow
A: 0 to 1 lines having transfer hollow per 10 line images
B: 2 to 5 lines having transfer hollow per 10 line images
C: 6 to 10 lines having transfer hollow per 10 line images
*2Filming
A: No filming occurred at all on the photosensitive member.
B: Filming partly occurred on the photosensitive member.
C: Filming occurred over the whole photosensitive member.
*2aOccurred on the 5,000th sheet.
*2bOccurred on the 6,000th sheet.
*2cOccurred on the 10,000th sheet.

What is claimed is:

1. An image forming apparatus comprising;

an electrostatic latent image bearing member having an organic photoconductive layer to bear thereon an electrostatic latent image; said electrostatic latent image bearing member containing fluorine-containing fine resin particles in its surface;

a contact charging member being in pressure-contact with the surface of said electrostatic latent image bearing member to electrostatically charge said electrostatic latent image bearing member upon application of a bias voltage;

a latent image forming means to form an electrostatic latent image on the electrostatically charged electrostatic latent image bearing member;

a developing means to develop the electrostatic latent image formed on said electrostatic latent image bearing member; said developing means holding a magnetic toner; said magnetic toner comprising magnetic toner particles containing at least a binder resin and a magnetic material;

wherein said binder resin contains a polymer synthesized from vinyl monomers in the presence of an aromatic organic solvent in an amount of not less than 50 parts by weight based on 100 parts by weight of the binder resin, and said magnetic toner particles contain said aromatic organic solvent in a quantity of not more than 500 ppm based on the weight of the magnetic toner particles;

a contact transfer member being in contact with the surface of the electrostatic latent image bearing member interposing a transfer medium between them to transfer the toner image formed by the developing means to said transfer medium; and a fixing means to fix said toner image on said transfer medium.

2. An image forming apparatus according to claim 1, wherein said aromatic organic solvent is selected from the group consisting of benzene, toluene, xylene, cyclohexane and tetrahydrofuran.

3. An image forming apparatus according to claim 1, wherein the polymer is synthesized from vinyl monomers in the presence of an aromatic organic solvent by solution polymerization.

4. An image forming apparatus according to claim 1, wherein said binder resin has a low molecular weight component having a peak molecular weight (Mp) from 4,000 to 30,000 in GPC chromatogram and a high molecular weight polymer having a peak molecular weight (Mp) from 200,000 to 1,000,000 in GPC chromatogram.

5. An image forming apparatus according to claim 4, wherein said binder resin is prepared by melt-kneading a low molecular weight polymer and a high molecular weight polymer.

6. An image forming apparatus according to claim 5, wherein said low molecular weight polymer has a peak molecular weight (Mp) from 4,000 to 30,000 in GPC chromatogram and said high molecular weight polymer has a peak molecular weight (Mp) from 200,000 to 1,000,000 in GPC chromatogram.

7. An image forming apparatus according to claim 5, wherein said low molecular weight polymer has a peak molecular weight (Mp) from 7,000 to 20,000 in GPC chromatogram and said high molecular weight polymer has a peak molecular weight (Mp) from 300,000 to 700,000 in GPC chromatogram.

8. An image forming apparatus according to claim 4, wherein said low molecular weight component comprises a polymer synthesized by solution polymerization and said high molecular weight component comprises a polymer synthesized by suspension polymerization.

9. An image forming apparatus according to claim 4, wherein said low molecular weight component comprises a polymer synthesized by polymerization using a monofunctional radical initiator and said high molecular weight component comprises a polymer synthesized by polymerization using a polyfunctional radical initiator.

10. An image forming apparatus according to claim 1, wherein said magnetic toner has a glass transition point (Tg) from 45° C. to 80° C.

11. An image forming apparatus according to claim 1, wherein said magnetic toner has a glass transition point (Tg) from 50° C. to 70° C.

12. An image forming apparatus according to claim 1, wherein said magnetic toner particles contain a polyolefin.

13. An image forming apparatus according to claim 12, wherein said polyolefin comprises a homopolymer of an α-olefin, a copolymer of two or more α-olefins or an oxide of an α-olefin.

14. An image forming apparatus according to claim 13, wherein said polyolefin comprises a vinyl type graft-modified polyolefin.

15. An image forming apparatus according to claim 14, wherein said vinyl type graft-modified polyolefin is graft-modified with an aliphatic vinyl monomer or aromatic vinyl monomer.

16. An image forming apparatus according to claim 12, wherein said polyolefin has a weight average molecular weight from 2,000 to 30,000 as measured by GPC.

17. An image forming apparatus according to claim 12, wherein said polyolefin has a weight average molecular weight from 5,000 to 18,000 as measured by GPC.

18. An image forming apparatus according to claim 12, wherein said magnetic toner particles contain the polyolefin in an amount from 0.1 part by weight to 20 parts by weight based on 100 parts by weight of the binder resin.

19. An image forming apparatus according to claim 12, wherein said magnetic toner particles contain the polyolefin in an amount from 0.1 part by weight to 10 parts by weight based on 100 parts by weight of the binder resin.

20. An image forming apparatus according to claim 1, wherein said polymer used in said magnetic toner particles is prepared by polymerizing vinyl monomers in the presence of the aromatic organic solvent; drying the resulting polymer to remove said solvent under normal pressure at a temperature of 30° C. to 50° C. for 5 hours to 48 hours, and thereafter, drying the resulting polymer to remove said solvent under absolute pressure of from 10 mmHg to 500 mmHg at a temperature of 30° C. to 50° C. for 5 hours to 48 hours.

21. An image forming apparatus according to claim 1, wherein said polymer used in said magnetic toner particles is prepared by polymerizing vinyl monomers in the presence of the aromatic organic solvent; drying the resulting polymer to remove said solvent under normal pressure at a temperature of 35° C. to 45° C. for 8 hours to 36 hours, and thereafter, drying the resulting polymer to remove said solvent under absolute pressure of from 50 mmHg to 400 mmHg at a temperature of 35° C. to 45° C. for 8 hours to 36 hours.

22. An image forming apparatus according to claim 1, wherein said magnetic toner contains a fine silica powder in an amount from 0.01 part by weight to 8 parts by weight based on 100 parts by weight of the magnetic toner particles.

23. An image forming apparatus according to claim 1, wherein said magnetic toner contains a fine silica powder in an amount of from 0.01 part by weight to 5 parts by weight based on 100 parts by weight of the magnetic toner particles.

24. An image forming apparatus according to claim 31, wherein said fluorine-containing fine resin particles comprise a polymer selected from the group consisting of polytetrafluoroethylene, polychlorotrifluoroethylene, polyvinylidene fluoride, polydichlorodifluoroethylene, a tetrafluoroethylene/perfluoroalkyl/vinyl ether copolymer, a tetrafluoroethylene/hexafluoropropylene copolymer, a tetrafluoroethylene/ethylene copolymer and a tetrafluoroethylene/hexafluoropropylene/perfluoroalkyl vinyl ether copolymer.

25. An image forming apparatus according to claim 1, wherein said fluorine-containing fine resin particles have a weight average molecular weight from 3,000 to 5,000,000.

26. An image forming apparatus according to claim 1, wherein said electrostatic latent image bearing member has a surface comprising a charge transport layer formed on a charge generation layer.

27. An image forming apparatus according to claim 26, wherein said fluorine-containing fine resin particles are contained in said charge transport layer in an amount from 5% by weight to 30% by weight based on the total weight of the charge transport layer.

28. An image forming apparatus according to claim 26, wherein said fluorine-containing fine resin particles are contained in said charge transport layer in an amount from 10% by weight to 25% by weight based on the total weight of the charge transport layer.

29. An image forming apparatus according to claim 1, wherein said electrostatic latent image bearing member has a surface comprising a protective layer formed on an organic photoconductive layer.

30. An image forming apparatus according to claim 29, wherein said fluorine-containing fine resin particles are contained in said protective layer in an amount from 5% by weight to 40% by weight based on the total weight of the protective layer.

31. An image forming apparatus according to claim 29, wherein said fluorine-containing fine resin particles are contained in said protective layer in an amount from 10% by weight to 40% by weight based on the total weight of the protective layer.

32. An image forming apparatus according to claim 1, which further comprises a cleaning means for removing contaminants on the surface of said electrostatic latent image bearing member, said cleaning means being in contact with the surface of said image bearing member.

33. An apparatus unit detachable from the main body of an image forming apparatus, comprising at least:

an electrostatic latent image bearing member having an organic photoconductive layer to bear thereon an electrostatic latent image; said electrostatic latent image bearing member containing fluorine-containing fine resin particles in its surface;

a contact charging member being in pressure-contact with the surface of said electrostatic latent image bearing member to electrostatically charge said electrostatic latent image bearing member upon application of a bias voltage; and a developing means to develop the electrostatic latent image formed on said electrostatic latent image bearing member; said developing means holding a magnetic toner said magnetic toner comprising magnetic toner particles containing at least a binder resin and a magnetic material wherein said binder resin contains a polymer synthesized from vinyl monomers in the presence of an aromatic organic solvent in an amount of not less than 50 parts by weight based on 100 parts by weight of the binder resin, and said magnetic toner particles contain said aromatic organic solvent in a quantity of not more than 500 ppm based on the weight of the magnetic toner particles.

34. An apparatus unit according to claim 33, wherein said aromatic organic solvent is selected from the group consisting of benzene, toluene, xylene, cyclohexane and tetrahydrofuran.

35. An apparatus unit according to claim 33, wherein the polymer is synthesized from vinyl monomers in the presence of an aromatic organic solvent by solution polymerization.

36. An apparatus unit according to claim 33, wherein said binder resin has a low molecular weight component having a peak molecular weight (Mp) from 4,000 to 30,000 in GPC chromatogram and a high molecular weight polymer having peak molecular weight (Mp) from 200,000 to 1,000,000 in GPC chromatogram.

37. An apparatus unit according to claim 36, wherein said binder resin is prepared by melt-kneading a low molecular weight polymer and high molecular weight polymer.

38. An apparatus unit according to claim 37, wherein said low molecular weight polymer has a peak molecular weight (Mp) from 4,000 to 30,000 in GPC chromatogram and said high molecular weight polymer has a peak molecular weight (Mp) from 200,000 to 1,000,000 in GPC chromatogram.

39. An apparatus unit according to claim 37, wherein said low molecular weight polymer has a peak molecular weight (Mp) from 7,000 to 20,000 in GPC chromatogram and said high molecular weight polymer has a peak molecular weight (Mp) from 300,000 to 700,000 in GPC chromatogram.

40. An apparatus unit according to claim 36, wherein said low molecular weight component comprises a polymer synthesized by solution polymerization and said high molecular weight component comprises a polymer synthesized by suspension polymerization.

41. An apparatus unit according to claim 36, wherein said low molecular weight component comprises a polymer synthesized by polymerization using a monofunctional radical initiator and said high molecular weight component comprises a polymer synthesized by polymerization using a polyfunctional radical initiator.

42. An apparatus unit according to claim 33, wherein said magnetic toner has a glass transition point (Tg) from 45° C. to 80° C.

43. An apparatus unit according to claim 33, wherein said magnetic toner has a glass transition point (Tg) from 50° C. to 70° C.

44. An apparatus unit according to claim 33, wherein said magnetic toner contains a polyolefin.

45. An apparatus unit according to claim 44, wherein said polyolefin comprises a homopolymer of an $\alpha$-olefin, a copolymer of two or more $\alpha$-olefins or an oxide of an $\alpha$-olefin.

46. An apparatus unit according to claim 45, wherein said polyolefin comprises a vinyl type graft-modified polyolefin.

47. An apparatus unit according to claim 46, wherein said vinyl type graft-modified polyolefin is graft-modified with an aliphatic vinyl monomer or aromatic vinyl monomer.

48. An apparatus unit according to claim 44, wherein said polyolefin has a weight average molecular weight from 2,000 to 30,000 as measured by GPC.

49. An image forming apparatus according to claim 44, wherein said polyolefin has a weight average molecular weight from 5,000 to 18,000 as measured by GPC.

50. An apparatus unit according to claim 44, wherein said magnetic toner contains the polyolefin in an amount from 0.1 part by weight to 20 parts by weight based on 100 parts by weight of the binder resin.

51. An apparatus unit according to claim 44, wherein said magnetic toner contains the polyolefin in an amount from 0.1 part by weight to 10 parts by weight based on 100 parts by weight of the binder resin.

52. An apparatus unit according to claim 33, wherein said polymer used in said magnetic toner particles is prepared by polymerizing vinyl monomers in the presence of the aromatic organic solvent; drying the resulting polymer to remove said solvent under normal pressure at a temperature of 30° C. to 50° C. for 5 hours to 48 hours, and thereafter, drying the resulting polymer to remove said solvent under absolute pressure of from 10 mmHg to 500 mmHg at a temperature of 30° C. to 50° C. for 5 hours to 48 hours.

53. An apparatus unit according to claim 33, wherein said polymer used in said magnetic toner particles is prepared by polymerizing vinyl monomers in the presence of the aromatic organic solvent; drying the resulting polymer to remove said solvent under normal pressure at a temperature of 35° C. to 45° C. for 8 hours to 36 hours, and thereafter, drying the resulting polymer to remove said solvent under absolute pressure of from 50 mmHg to 400 mmHg at a temperature of 35° C. to 45° C. for 8 hours to 36 hours.

54. An apparatus unit according to claim 33, wherein said magnetic toner contains a fine silica powder in an amount of from 0.01 part by weight to 8 parts by weight based on 100 parts by weight of the magnetic toner particles.

55. An apparatus unit according to claim 33, wherein said magnetic toner contains a fine silica powder in an amount of from 0.01 part by weight to 5 parts by weight based on 100 parts by weight of the magnetic toner particles.

56. An apparatus unit according to claim 33, wherein said fluorine-containing fine resin particles comprise a polymer selected from the group consisting of polytetrafluoroethylene, polychlorotrifluoroethylene, polyvinylidene fluoride, polydichlorodifluoroethylene, a tetrafluoro-ethylene/perfluoroalkyl/vinyl ether copolymer, a tetrafluoroethylene/hexafluoropropylene copolymer, a tetrafluoroethylene/ethylene copolymer and a tetrafluoroethylene/hexafluoropropylene/perfluoroalkyl vinyl ether copolymer.

57. An apparatus unit according to claim 33, wherein said fluorine-containing fine resin particles have a weight average molecular weight from 3,000 to 5,000,000.

58. An apparatus unit according to claim 1, wherein said electrostatic latent image bearing member has a surface comprising a charge transport layer formed on a charge generation layer.

59. An apparatus unit according to claim 58, wherein said fluorine-containing fine resin particles are contained in said charge transport layer in an amount from 5% by weight to 30% by weight based on the total weight of the charge transport layer.

60. An apparatus unit according to claim 58, wherein said fluorine-containing fine resin particles are contained in said charge transport layer in an amount from 10% by weight to 25% by weight based on the total weight of the charge transport layer.

61. An apparatus unit according to claim 33, wherein said electrostatic latent image bearing member has a surface comprising a protective layer formed on an organic photoconductive layer.

62. An apparatus unit according to claim 61, wherein said fluorine-containing fine resin particles are contained in said protective layer in an amount from 5% by weight to 40% by weight based on the total weight of the protective layer.

63. An apparatus unit according to claim 61, wherein said fluorine-containing fine resin particles are contained in said protective layer in an amount from 10% by weight to 40% by weight based on the total weight of the protective layer.

64. An apparatus unit according to claim 33, wherein in addition to said electrostatic latent image bearing member, said contact charging member and said developing means, a cleaning means for removing contaminants on the surface of said electrostatic latent image bearing member is integrated in said apparatus unit which is detachable from the main body of said image forming apparatus, said cleaning means being in contact with the surface of said latent image bearing member.

65. An image forming apparatus comprising:

an electrostatic image bearing member having an organic photoconductive layer to bear thereon an electrostatic latent image; said electrostatic latent image bearing member containing fluorine-containing fine resin particles in its surface;

a contact charging member being in pressure-contact with the surface of said electrostatic latent image bearing member to electrostatically charge said electrostatic latent image bearing member upon application of a bias voltage;

a latent image forming means to form an electrostatic latent image on the electrostatically charged electrostatic latent image bearing member;

a developing means to develop the electrostatic latent image formed on said electrostatic latent image bearing member; said developing means holding a toner; said toner comprising toner particles containing at least a binder resin and a colorant;

wherein said binder resin contains a polymer synthesized from vinyl monomers in the presence of an aromatic organic solvent, and said toner contains said aromatic organic solvent in a quantity of not more than 500 ppm based on the weight of the toner particles; and a cleaning means for removing contaminants on the surface of said electrostatic latent image bearing member, said cleaning means being in contact with the surface of said image bearing member.

66. An image forming apparatus according to claim 65, which further comprises a contact transfer member being in contact with the surface of the electrostatic latent image bearing member interposing a transfer medium between them to transfer the toner image formed by the developing means to said transfer medium.

67. An image forming apparatus according to claim 65, wherein said binder resin contains said polymer in an amount of not less than 50 parts by weight based on 100 parts by weight of the binder resin.

68. An image forming apparatus according to claim 65, wherein said aromatic organic solvent is selected from the group consisting of benzene, toluene, xylene, cyclohexane and tetrahydrofuran.

69. An image forming apparatus according to claim 65, wherein the polymer is synthesized from vinyl monomers in the presence of an aromatic organic solvent by solution polymerization.

70. An image forming apparatus according to claim 65, wherein said binder resin has a low molecular weight component having a peak molecular weight (Mp) from 4,000 to 30,000 in GPC chromatogram and a high molecular weight polymer having a peak molecular weight (Mp) from 200,000 to 1,000,000 in GPC chromatogram.

71. An image forming apparatus according to claim 70, wherein said binder resin is prepared by melt-kneading a low molecular weight polymer and a high molecular weight polymer.

72. An image forming apparatus according to claim 71, wherein said low molecular weight polymer has a peak molecular weight (Mp) from 4,000 to 30,000 in GPC chromatogram and said high molecular weight polymer has a peak molecular weight (Mp) from 200,000 to 1,000,000 in GPC chromatogram.

73. An image forming apparatus according to claim 71, wherein said low molecular weight polymer has a peak molecular weight (Mp) from 7,000 to 20,000 in GPC chromatogram and said high molecular weight polymer has a peak molecular weight (Mp) from 300,000 to 700,000 in GPC chromatogram.

74. An image forming apparatus according to claim 70, wherein said low molecular weight component comprises a polymer synthesized by solution polymerization and said high molecular weight component comprises a polymer synthesized by suspension polymerization.

75. An image forming apparatus according to claim 70, wherein said low molecular weight component comprises a polymer synthesized by polymerization using a monofunctional radical initiator and said high molecular weight component comprises a polymer synthesized by polymerization using a polyfunctional radical initiator.

76. An image forming apparatus according to claim 65, wherein said toner has a glass transition point (Tg) from 45° C. to 80° C.

77. An image forming apparatus according to claim 65, wherein said toner has a glass transition point (Tg) from 50° C. to 70° C.

78. An image forming apparatus according to claim 65, wherein said polymer used in said toner particles is prepared by polymerizing vinyl monomers in the presence of the aromatic organic solvent; drying the resulting polymer to remove said solvent under normal pressure at a temperature of 30° C. to 50° C. for 5 hours to 48 hours, and thereafter drying the resulting polymer to remove said solvent under absolute pressure from 10 mmHg to 500 mmHg at a temperature of 30° C. to 50° C. for 5 hours to 48 hours.

79. An image forming apparatus according to claim 65, wherein said polymer used in said toner particles is prepared by polymerizing vinyl monomers in the presence of the aromatic organic solvent; drying the resulting polymer to remove said solvent under normal pressure at a temperature of 35° C. to 45° C. for 8 hours to 36 hours, and thereafter, drying the resulting polymer to remove said solvent under absolute pressure of from 50 mmHg to 400 mmHg at a temperature of 35° C. to 45° C. for 8 hours to 36 hours.

80. An image forming apparatus according to claim 65, wherein said fluorine-containing fine resin particles comprise a polymer selected from the group consisting of polytetrafluoroethylene, polychlorotrifluoroethylene, polyvinylidene fluoride, polydichlorodifluoroethylene, a tetrafluoroethylene/perfluoroalkyl/vinyl ether copolymer, a tetrafluoroethylene/hexafluoropropylene copolymer, a tetrafluoroethylene/ethylene copolymer, and a tetrafluoroethylene/hexafluoropropylene/perfluoroalkyl vinyl ether copolymer.

81. An image forming apparatus according to claim 65, wherein said fluorine-containing fine resin particles have a weight average molecular weight from 3,000 to 5,000,000.

82. An image forming apparatus according to claim 65, wherein said electrostatic latent image bearing member has a surface comprising a charge transport layer formed on a charge generation layer.

83. An image forming apparatus according to claim 82, wherein said fluorine-containing fine resin particles are contained in said charge transport layer in an amount from 5% by weight to 30% by weight based on the total weight of the charge transport layer.

84. An image forming apparatus according to claim 82, wherein said fluorine-containing fine resin particles are contained in said charge transport layer in an amount from 10% by weight to 25% by weight based on the total weight of the charge transport layer.

85. An image forming apparatus according to claim 65, wherein said electrostatic latent image bearing member has a surface comprising a protective layer formed on an organic photoconductive layer.

86. An image forming apparatus according to claim 85, wherein said fluorine-containing fine resin particles are contained in said protective layer in an amount from 5% by weight to 40% by weight based on the total weight of the protective layer.

87. An image forming apparatus according to claim 85, wherein said fluorine-containing fine resin particles are contained in said protective layer in an amount from 10% by weight to 40% by weight based on the total weight of the protective layer.

88. An apparatus unit detachable from the main body of an image forming apparatus, comprising at least:

an electrostatic latent image bearing member having an organic photoconductive layer to bear thereon an electrostatic latent image; said electrostatic latent image bearing member containing fluorine-containing fine resin particles in its surface;

a contact charging member being in pressure-contact with the surface of said electrostatic latent image bearing member to electrostatically charge said electrostatic latent image bearing member upon application of a bias voltage;

a developing means to develop the electrostatic latent image formed on said electrostatic latent image bearing member; said developing means holding a toner; said toner comprising toner containing at least a binder resin and a colorant wherein said binder resin contains a polymer synthesized from vinyl monomers in the presence of an aromatic organic solvent, and said toner particles contains said aromatic organic solvent in a quantity of not more than 500 ppm based on the weight of the toner particles; and a cleaning means for removing contaminants on the surface of said electrostatic latent image bearing member, said cleaning means being in contact with the surface of said image bearing member.

89. An apparatus unit according to claim 88, wherein said binder resin contains said polymer in an amount of not less than 50 parts by weight based on 100 parts by weight of the binder resin.

90. An apparatus unit according to claim 88, wherein said aromatic organic solvent is selected from the group consisting of benzene, toluene, xylene, cyclohexane and tetrahydrofuran.

91. An apparatus unit according to claim 88, wherein the polymer is synthesized from vinyl monomers in the presence of an aromatic organic solvent by solution polymerization.

92. An apparatus unit according to claim 88, wherein said binder resin has a low molecular weight component having a peak molecular weight (Mp) from 4,000 to 30,000 in GPC chromatogram and a high molecular weight polymer having a peak molecular weight (Mp) from 200,000 to 1,000,000 in GPC chromatogram.

93. An apparatus unit according to claim 92, wherein said binder resin is prepared by melt-kneading a low molecular weight polymer and a high molecular weight polymer.

94. The apparatus unit according to claim 93, wherein said low molecular weight polymer has a peak molecular weight (Mp) from 4,000 to 30,000 in GPC chromatogram and said high molecular weight polymer has a peak molecular weight (Mp) from 200,000 to 1,000,000 in GPC chromatogram.

95. An apparatus unit according to claim 93, wherein said low molecular weight polymer has a peak molecular weight (Mp) from 7,000 to 20,000 in GPC chromatogram and said high molecular weight polymer has a peak molecular weight (Mp) from 300,000 to 700,000 in GPC chromatogram.

96. An apparatus unit according to claim 92, wherein said low molecular weight component comprises a polymer synthesized by solution polymerization and said high molecular weight component comprises a polymer synthesized by suspension polymerization.

97. An apparatus unit according to claim 92, wherein said low molecular weight component comprises a polymer synthesized by polymerization using a monofunctional radical initiator and said high molecular weight component comprises a polymer synthesized by polymerization using a polyfunctional radical initiator.

98. An apparatus unit according to claim 88, wherein said toner has a glass transition point (Tg) from 45° C. to 80° C.

99. An apparatus unit according to claim 88, wherein said toner has a glass transition point (Tg) from 50° C. to 70° C.

100. An apparatus unit according to claim 88, wherein said polymer used in said toner particles is prepared by polymerizing vinyl monomers in the presence of the aromatic organic solvent; drying the resulting polymer to remove said solvent under normal pressure at a temperature of 30° C. to 50° C. for 5 hours to 48 hours, and thereafter drying the resulting polymer to remove said solvent under absolute pressure from 10 mmHg to 500 mmHg at a temperature of 30° C. to 50° C. for 5 hours to 48 hours.

101. An apparatus unit according to claim 88, wherein said polymer used in said toner particles is prepared by polymerizing vinyl monomers in the presence of the aromatic organic solvent; drying the resulting polymer to remove said solvent under normal pressure at a temperature of 35° C. to 45° C. for 8 hours to 36 hours, and thereafter, drying the resulting polymer to remove said solvent under absolute pressure of from 50 mmHg to 400 mmHg at a temperature of 35° C. to 45° C. for 8 hours to 36 hours.

102. An apparatus unit according to claim 88, wherein said fluorine-containing fine resin particles comprise a polymer selected from the group consisting of polytetrafluoroethylene, polychlorotrifluoroethylene, polyvinylidene fluoride, polydichlorodifluoroethylene, a tetrafluoro-ethylene/perfluoroalkyl/vinyl ether copolymer, a tetrafluoroethylene/hexafluoropropylene copolymer, a tetrafluoroethylene/ethylene copolymer, and a tetrafluoroethylene/hexafluoropropylene/perfluoroalkyl vinyl ether copolymer.

103. An apparatus unit according to claim 88, wherein said fluorine-containing fine resin particles have a weight average molecular weight from 3,000 to 5,000,000.

104. An apparatus unit according to claim 88, wherein said electrostatic latent image bearing member has a surface comprising a charge transport layer formed on a charge generation layer.

105. An apparatus unit according to claim 104, wherein said fluorine-containing fine resin particles are contained in said charge transport layer in an amount from 5% by weight to 30% by weight based on the total weight of the charge transport layer.

106. An apparatus unit according to claim 104, wherein said fluorine-containing fine resin particles are contained in said charge transport layer in an amount from 10% by weight to 25% by weight based on the total weight of the charge transport layer.

107. An apparatus unit according to claim 88, wherein said electrostatic latent image bearing member has a surface comprising a protective layer formed on an organic photoconductive layer.

108. An apparatus unit according to claim 107, wherein said fluorine-containing fine resin particles are contained in said protective layer in an amount from 5% by weight to 40% by weight based on the total weight of the protective layer.

109. An apparatus unit according to claim 107, wherein said fluorine-containing fine resin particles are contained in said protective layer in an amount from 10% by weight to 40% by weight based on the total weight of the protective layer.

* * * * *

UNITED STATES PATENT AND TRADEMARK OFFICE

CERTIFICATE OF CORRECTION

PATENT NO. : 5,436,701

DATED : July 25, 1995

INVENTOR(S) : MINORU SHIMOJO, ET AL.

It is certified that error appears in the above-indentified patent and that said Letters Patent is hereby corrected as shown below:

Title page, item [56], change the dates.

Foreign Patent Documents, "4223910 11/1957 Japan
4324748 10/1958 Japan" should read --42-23910 11/1967 Japan
43-24748 10/1968 Japan--.

COLUMN 1

Line 27, "No. 43-4748." should read --No. 43-24748.--.

COLUMN 3

Line 7, "change," should read --change--;

Line 21, "apes" should read --area--;

Line 23, "poop" should read --poor--; and

Line 35, "varies" should read --vary--.

COLUMN 4

Line 9, "of-the" should read --of the--; and

Line 24, "gins" should read --sins--.

COLUMN 5

Line 24, "an" (first occurrence) should read --a--;

Line 51, "comprising;" should read --comprising:--; and

Line 53, "an" should read --a--.

UNITED STATES PATENT AND TRADEMARK OFFICE

CERTIFICATE OF CORRECTION

PATENT NO. : 5,436,701

DATED : July 25, 1995

INVENTOR(S) : MINORU SHIMOJO, ET AL.

It is certified that error appears in the above-indentified patent and that said Letters Patent is hereby corrected as shown below:

COLUMN 6

Line 15, "comprising;" should read --comprising:--;

Line 16, "an" should read --a--; and

Line 50, "an" should read --a--.

COLUMN 7

Line 24, "invention," should read --invention.--; and

Line 59, "synthesis" should read --synthesize--.

COLUMN 10

Line 66, "10" should be deleted.

COLUMN 11

Line 39, "1-hydroxy-4-naphthoslulfonate" should read --1-hydroxy-4-naphthosulfonate--.

COLUMN 12

Line 11, "those" should read --those which--; and "resin" should read --resins--.

COLUMN 13

Line 5, "readting" should read --reacting--.

UNITED STATES PATENT AND TRADEMARK OFFICE

CERTIFICATE OF CORRECTION

PATENT NO. : 5,436,701

DATED : July 25, 1995

INVENTOR(S) : MINORU SHIMOJO, ET AL.

It is certified that error appears in the above-indentified patent and that said Letters Patent is hereby corrected as shown below:

COLUMN 14

Line 24, "use," should read --use--; and

Line 61, "silicic," should read --silicate,--.

COLUMN 15

Line 13, "Quaetz" should read --Quartz--;

Line 14, "Illinis" should read --Illinois--; and

Line 21, "kogyo" should read --Kogyo--.

COLUMN 17

Line 25, "to" should be deleted; and

Line 44, "below. (1) Measurement" should read --below. ¶ (1) Measurement--.

COLUMN 18

Line 31, "Ltd. (3)" should read --Ltd. ¶ (3)--; and

Line 41, "chromatography" should read --Chromatography--.

COLUMN 22

Line 34, ":facsimile" should read --facsimile--; and

Line 63, "not-more" should read --not more--.

UNITED STATES PATENT AND TRADEMARK OFFICE

CERTIFICATE OF CORRECTION

PATENT NO. : 5,436,701

DATED : July 25, 1995

INVENTOR(S) : MINORU SHIMOJO, ET AL.

It is certified that error appears in the above-indentified patent and that said Letters Patent is hereby corrected as shown below:

COLUMN 23

Line 3, "any,transfer" should read --any, transfer--.

COLUMN 24

Line 37, "examples;" should read --examples:--.

COLUMN 25

Line 27, "member" should read --Member--; and

Line 63, "discolored" should read --dissolved--.

COLUMN 27

Line 12, "50°C.," should read --250°C.,--.

COLUMN 28

Line 17, "comprising;" should read --comprising:--.

COLUMN 30

Line 26, "31," should read --1,--.

COLUMN 31

Line 19, "toner said" should read --toner; said--.

UNITED STATES PATENT AND TRADEMARK OFFICE

CERTIFICATE OF CORRECTION

PATENT NO. : 5,436,701

DATED : July 25, 1995

INVENTOR(S) : MINORU SHIMOJO, ET AL.

It is certified that error appears in the above-indentified patent and that said Letters Patent is hereby corrected as shown below:

COLUMN 32

Line 10, "toner contains" should read --toner particles contain--;

Line 25, "image forming apparatus" should read --apparatus unit--; and

Line 29, "toner contains" should read --toner particles contain--.

COLUMN 33

Line 12, "claim 1," should read --claim 33,--.

COLUMN 36

Line 14, "containing" should read --particles containing--; and

UNITED STATES PATENT AND TRADEMARK OFFICE

CERTIFICATE OF CORRECTION

PATENT NO. : 5,436,701

DATED : July 25, 1995

INVENTOR(S) : MINORU SHIMOJO, ET AL.

It is certified that error appears in the above-indentified patent and that said Letters Patent is hereby corrected as shown below:

COLUMN 36,

Line 18, "contains" should read --contain--.

Signed and Sealed this

Ninth Day of January, 1996

Bruce Lehman

*Attest:*

BRUCE LEHMAN

*Attesting Officer*

*Commissioner of Patents and Trademarks*